US012741768B2

(12) United States Patent
Brown et al.

(10) Patent No.: US 12,741,768 B2
(45) Date of Patent: Sep. 22, 2026

(54) BALE PACKING ASSEMBLY AND METHOD

(71) Applicant: Border Valley LLC, Brawley, CA (US)

(72) Inventors: Walker Brown, Brawley, CA (US); Marius Lipan, Brawley, CA (US); Joshuah Tait, Brawley, CA (US)

(73) Assignee: Border Valley LLC, Brawley, CA (US)

( * ) Notice: Subject to any disclaimer, the term of this patent is extended or adjusted under 35 U.S.C. 154(b) by 108 days.

(21) Appl. No.: 18/829,163

(22) Filed: Sep. 9, 2024

(65) Prior Publication Data

US 2026/0070690 A1 Mar. 12, 2026

(51) Int. Cl.

| | |
|---|---|
| ***B65B 25/02*** | (2006.01) |
| ***B65B 1/32*** | (2006.01) |
| ***B65B 7/02*** | (2006.01) |
| ***B65B 13/02*** | (2006.01) |
| ***B65B 35/02*** | (2006.01) |
| ***B65B 57/14*** | (2006.01) |
| ***B65B 61/26*** | (2006.01) |

(52) U.S. Cl.

CPC ..... *B65B 25/02* (2013.01); *B65B 1/32* (2013.01); *B65B 7/02* (2013.01); *B65B 13/02* (2013.01); *B65B 35/02* (2013.01); *B65B 57/14* (2013.01); *B65B 61/26* (2013.01)

(58) Field of Classification Search

CPC .. B65B 25/02; B65B 1/32; B65B 7/02; B65B 13/02; B65B 35/02; B65B 57/14; B65B 61/26

See application file for complete search history.

(56) References Cited

U.S. PATENT DOCUMENTS

| | | | | |
|---|---|---|---|---|
| 3,815,321 A * | 6/1974 | Hartman | B65B 57/14 | 53/244 |
| 3,897,674 A * | 8/1975 | Higgins | B65B 9/135 | 53/66 |
| 3,977,155 A * | 8/1976 | Spaulding | B65B 63/02 | 53/529 |
| 4,050,219 A * | 9/1977 | Higgins | B65B 9/135 | 53/567 |

(Continued)

OTHER PUBLICATIONS

Video titled "Loading doubled compressed hay into an Andy by Anderson Hay box," uploaded to https://www.youtube.com/watch?v=oE0w90TmkDQ&t=5s by Anderson Hay Company in 2023, 2 pp.

*Primary Examiner* — Dariush Seif

(74) *Attorney, Agent, or Firm* — Neal, Gerber & Eisenberg LLP

(57) ABSTRACT

A fully automated system and methods for individually packaging double-compressed bales of hay, straw or the like is disclosed, together with unique apparatus for facilitating the same. Compressed bales are presented to a conveyor from which bales are isolated and maneuvered to a scale for inspection. Bags are positioned and opened using a bag handler system and presented to receive bales that pass inspection. The individually bagged bales are then deposited upside down along a sealing line here the bag bottom is automatically closed and sealed. The bale position is corrected and bales are assembled into logs and banded. The logs are then palletized and wrapped for shipping.

20 Claims, 24 Drawing Sheets

(56) References Cited

U.S. PATENT DOCUMENTS 4,063,401 A * 12/1977 Higgins ..... B65B 9/135 53/567
4,183,194 A * 1/1980 Lucke ..... B65B 43/36 53/374.6
4,302,141 A * 11/1981 Miguel ..... B65G 59/026 414/796.4
4,703,782 A * 11/1987 Henkel, Sr. ..... B65B 39/04 141/286
4,989,391 A * 2/1991 Wetter ..... B65B 39/007 53/202
5,117,614 A * 6/1992 Johnsen ..... B65B 35/50 53/247
5,628,168 A * 5/1997 Inman ..... A01F 25/14 53/575
6,032,439 A * 3/2000 Birkenfeld ..... B65B 9/135 53/567
6,112,504 A * 9/2000 McGregor ..... B65B 39/00 141/10
6,161,365 A * 12/2000 Girard ..... B65B 9/14 53/459
6,470,654 B1 * 10/2002 Lachenmeier ..... B65B 9/135 53/461
7,210,278 B2 * 5/2007 Chiu Chen ..... B65B 9/135 53/64
7,513,360 B1 * 4/2009 Bravo Lyon ..... B65D 71/02 206/83.5
7,987,651 B2 * 8/2011 Beeland ..... B65B 27/125 53/481
9,156,575 B2 * 10/2015 Potempa ..... B65B 27/125
9,193,490 B2 * 11/2015 Actis ..... B65B 63/02
9,650,161 B2 * 5/2017 Wehling ..... B65B 1/36
10,011,377 B2 * 7/2018 Oyama ..... B65B 51/146
10,292,337 B2 * 5/2019 Johnson ..... B65B 51/10
D885,929 S 6/2020 Standlee
10,800,559 B2 * 10/2020 Hansen ..... B65B 41/12
11,420,781 B2 * 8/2022 Sauerwein ..... B65B 9/14
12,297,002 B2 * 5/2025 Konstmann ..... B65B 9/135
2002/0108355 A1 * 8/2002 Vignoli ..... B65B 5/067 53/459
2003/0024211 A1 * 2/2003 Kckenmeister ..... B65B 9/026 53/529
2003/0217528 A1 * 11/2003 Wilson ..... B65B 1/32 53/469
2005/0204709 A1 * 9/2005 Berger ..... B65B 25/02 53/459
2006/0053750 A1 * 3/2006 Petersen ..... B65B 9/135 53/567
2009/0229226 A1 * 9/2009 Beeland ..... B65B 27/125 53/450
2009/0241487 A1 * 10/2009 Actis ..... B65B 65/00 53/563
2011/0036055 A1 * 2/2011 Shibagaki ..... B65B 43/50 53/266.1
2011/0258973 A1 * 10/2011 Czok ..... B65B 9/135 53/247
2012/0017543 A1 * 1/2012 Priepke ..... B65B 5/106 53/473
2012/0060448 A1 * 3/2012 Carmelo Calvano ... B65B 35/24 53/558
2012/0186197 A1 * 7/2012 Potempa ..... B65B 9/14 53/574
2013/0291485 A1 * 11/2013 McCorkle ..... B65B 39/02 53/473
2014/0245701 A1 * 9/2014 Loevenich ..... B65B 5/06 53/443
2014/0305542 A1 * 10/2014 Vollenkemper ..... B65B 1/06 141/69
2015/0210409 A1 * 7/2015 Berger ..... B65G 57/00 53/436
2016/0278295 A1 * 9/2016 Johnson ..... B65B 35/20
2016/0330910 A1 * 11/2016 Lininger ..... B65B 43/465
2019/0071199 A1 * 3/2019 Cassoli ..... B65B 59/003
2019/0270532 A1 * 9/2019 Johnson ..... B65B 27/125

* cited by examiner

BALE PACKING ASSEMBLY AND METHOD

TECHNICAL FIELD

This application relates to the packaging and shipping preparation of grasses, hay, straw, or the like, particularly in small, human-liftable unit sizes for manual disbursement. The apparatus, systems and methods disclosed herein improve on existing packing methods for such unit sizes, providing for efficiency, quality and utility in the final product.

BACKGROUND OF THE INVENTION

Hay is baled in many forms and sizes. Traditionally, balers turned out rectangular "single-compressed" bales roughly 36"×19"×15," held together around their length by two or three loops of twine. The twine is used to lift and carry the bale, the weight of which can vary anywhere from 50 to 125 pounds or more based on moisture content. This is a large and awkward size for a person to carry over any distance, and the bales are prone to coming apart if handled roughly. Though single-compressed rectangular bales do stack, their non-uniformity and relatively loose structure can lead to unstable loads that are difficult to work with. Further, single-compressed hay is costly to ship because it takes up more space.

These problems have been addressed to some extent by applying a secondary compression processing step to hay bales, resulting in bales of "double-compressed" hay. Such bales have roughly the same quantity (weight) of hay, but in a bale approximately half the size. These bales that have gone through a secondary compression process are also referred to as "½ cut bales." Not only are ½ cut bales easier for a person to maneuver, they are cheaper to ship and the double-compressed hay tends to keep longer when baled because it is less susceptible to intrusion by insects, mold and moisture. Still, some intrusion by these elements does occur and can destroy the product, which is why customers prefer double-compressed hay in human-maneuverable packaging that eliminates or at least further reduces such intrusion.

One example of double-compressed hay in small package size comes from Standlee Hay Company, which offers brief-case sized flakes from a ½ cut bale in an individual carry bag. Standlee has patented the design of its compressed bale bag, as seen in U.S. D885,929. But the process Standlee and others use to package and containerize double-compressed hay is manually intensive and inefficient. See, e.g., https://www.youtube.com/watch?v=oE0w90TmkDQ&t=5s, a video posted in 2023 by Anderson Hay Company showing a worker loading flakes (broken off portions) from ½ cut bales into cardboard boxes by hand. Based on these products and methods, the inventors of the present disclosure identified an opportunity for improvement to the way ½ cut bales are processed, packaged, and prepared for shipping, as well as for how the end product itself presents to the end consumer.

SUMMARY OF THE INVENTION

The invention is defined by the appended claims. This description summarizes some aspects of exemplary embodiments and is not intended to limit the claims. Other implementations are contemplated in accordance with the techniques described herein, as will be apparent to one having ordinary skill in the art upon examination of the following drawings and detail description, and such implementations are intended to be within the scope of this application.

In some embodiments, the invention includes special machinery designed to automatically manipulate, bag and seal bales of hay, straw, alfalfa, or the like, and prepare them for shipping. The invention may be comprised of one or more automated stations. One station may include a destacking station, where a stack of double compressed bales is received from a compressor and moved along a conveyor until it reaches a destacking elevator that isolates and selects a single bale for inspection. An inspection station may be used to determine if the bale is fit for packaging or needs to be reworked. This decision may be made locally or by a central controller connected over a network. A bagging station may comprise a bagging platform used to load the bale into a bag. The bagging station includes corner holders to hold the bag open on a first end after being pushed open with a blast of air from a pneumatic nozzle. A plunger deposits the bale into the bag before the filled bag descends down a chute onto a sealing line. The sealing line may comprise a closing assembly that, in turn, comprises a set of paddles and clamp gates to hold the bag closed before it is passed along a conveyor into a heat sealer where a bottom side of the bag is sealed. The invention may further include a bale flip that turns the sealed bag over to reveal a top flap and handle for lifting the now filled bag. In some embodiments, the filled bag is banded together with other bags in a banding device to form a log. The invention may also include a log lifting tool equipped with suctions to load logs and slip sheets of cardboard onto a pallet. It may also include a wrapping station where the pallet is shrink wrapped for shipping. The pallet may hold, for example, 24 bales in 6 separate logs, 2 across and three high.

In some embodiments, the invention includes bags of plastic that have approximately a 6 mil gauge on sides and 12 mil gauge on a closed top flap that contains a punched hole that serves as a handle. The plastic is breathable in that it has small perforations to allow the passage of air. It is clear so that it can be seen through, except that it may be branded or labeled on one side. The bags have an originally open end sized to receive a ½ cut bale weighing between 40 and 60 pounds. The open end is heat sealed once the bale is inserted. A serializer is used to mark the bag with information about the bale, such as the date it was packed. The serializer is in communication with a processor and memory at a central controller to share the information. The information can be obtained by an operator through a user interface.

In some embodiments, the invention includes a bagging station that includes a frame with suction cups to drop down and retrieve an empty bag. The frame travels along a gantry to move the bag into place, where an open end of the bag droops open from where it is held by the suction cups. An air nozzle is used to blast air into the open bag before corner holders flip open to hold the bag opened. The invention includes a bale handler that inserts the bale into the bag and extends a plunger to deposit it there. It also includes driven rollers that turn to move the bag with bale loaded backward and down a chute onto a sealing line where the top end is sealed with a heat sealer.

All of the foregoing steps and processes described above are configured to operate automatically without human intervention in response to either an indication from a position sensor or an instruction from a central controller via a communication network. A better understanding of the disclosure herein will be obtained from the following detailed description and accompanying drawings.

DETAILED DESCRIPTION

The description that follows describes, illustrates and exemplifies one or more embodiments in accordance with its principles. This description is not provided to limit the disclosure to the embodiment(s) described herein, but rather to explain and teach the principles of the invention(s) disclosed herein in order to enable one of ordinary skill in the art to understand these principles and, with that understanding, be able to apply them to practice not only the embodiment(s) described herein, but also any other embodiment that may come to mind in accordance with these principles. The scope of the disclosure is intended to cover all such embodiments that may fall within the scope of the appended claims, either literally or under the doctrine of equivalents.

Though this application primarily refers to hay, it will be understood by persons of skill in the art that the principles, methods and machinery described herein can equally be applied to bales of other organic materials of similar shape and manner such as straw, alfalfa, or other long grasses one may want to package for transport. Furthermore, the systems and methods described herein are not limited to a particular size of double-compressed hay or "½ cut" bales. Rather, as one of skill in the art would appreciate, the process may be implemented with other sized bales simply by scaling certain components of the system. Double compression makes the bales more dense and the hay (or other material) more fine, but the commodity at that density can be packed in various sizes. However, for exemplary purposes, the ½ cut bales 50 shown and described herein are generally square or slightly rectangular, having two "ends" 52 and four sides 54, and dimensions such that the weight is in a range of 40 to 60 lbs so as to be suitable for carrying in individual container bags by a human worker.

Figure 1A:
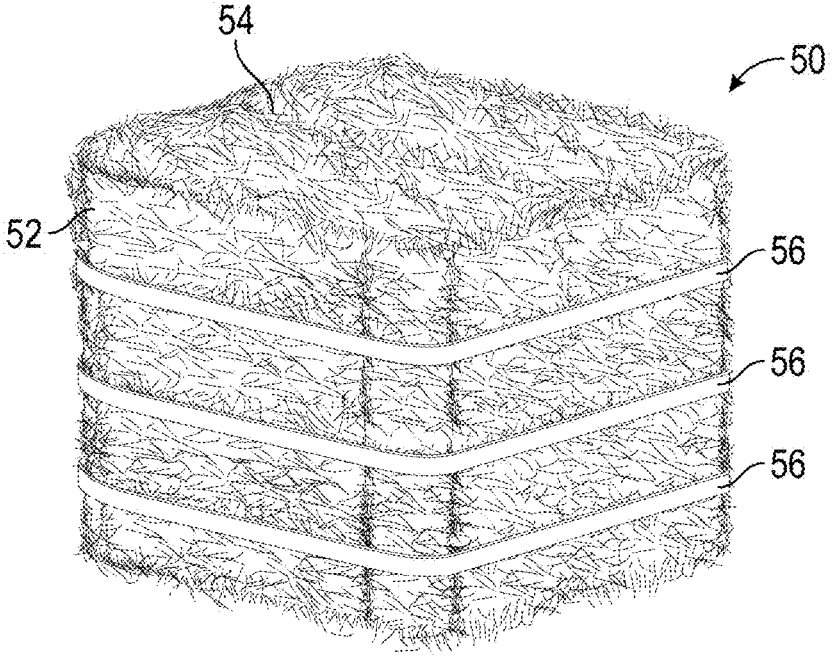
FIG. 1A is an exemplary single, unpacked ½ cut bale.
Figure 1B:
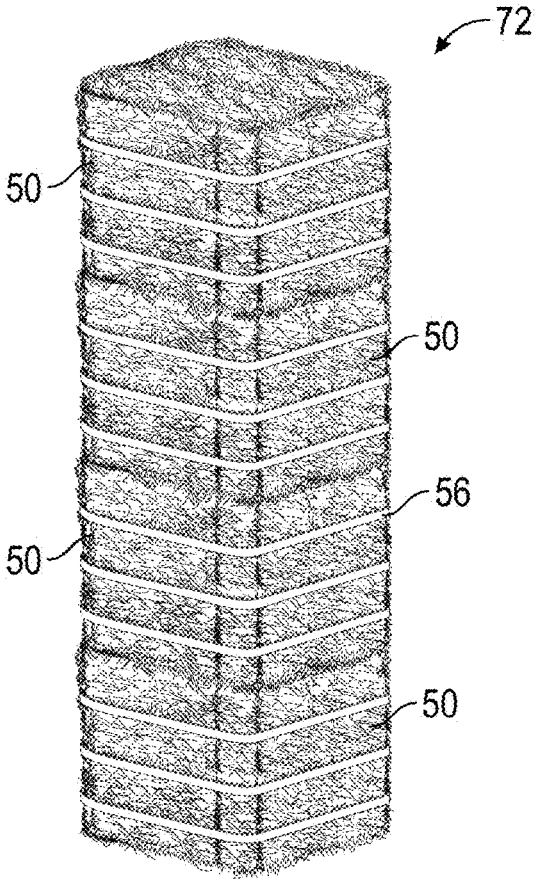
FIG. 1B is an exemplary unbanded receiving log comprised of unpacked ½ cut bales.

FIG. 1A shows a single, unpacked ½ cut bale 50. ½ cut bales (or simply "bales" as used herein) may be described as having ends because they come apart and are generally dispersed in flakes, where the flakes are compressed together from end to end. Thus, there is typically one or more plastic straps 56 around the outside of the ½ cut bale that pass over each end 52 to hold the ½ cut bale 50 together until ready to be used. Though traditional twine can also be used, plastic strapping is stronger and can be easily applied with a tensioner and bonding device or automated strapping machine. During handling, multiple ½ cut bales 50 may be positioned side by side into what is referred to as a log. A log may be comprised of different numbers of bales, but for purpose of explanation here, logs are disclosed in non-limiting fashion as being comprised of four ½ cut bales each. FIG. 1B shows a log of unpacked, strapped ½ cut bales 50. Such logs, referred to herein as unbanded receiving logs 72, are the input to the present system.

Figure 2A:
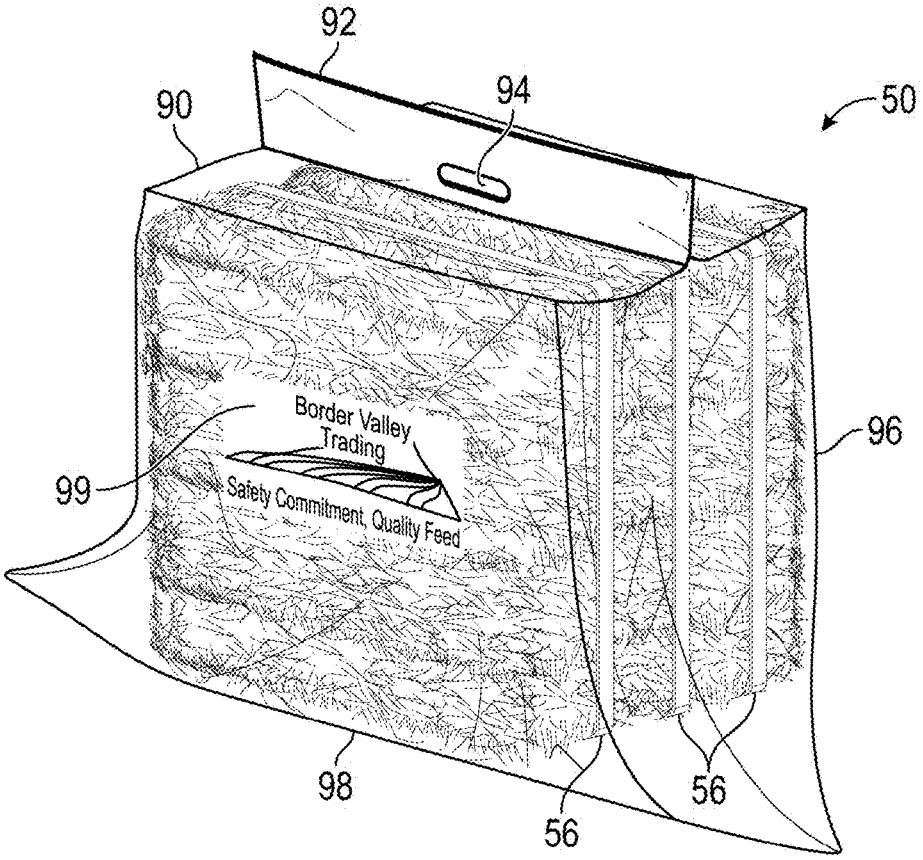
FIG. 2A is a single ½ cut bale sealed in a container bag in accordance with embodiments of the present invention.
Figure 2B:
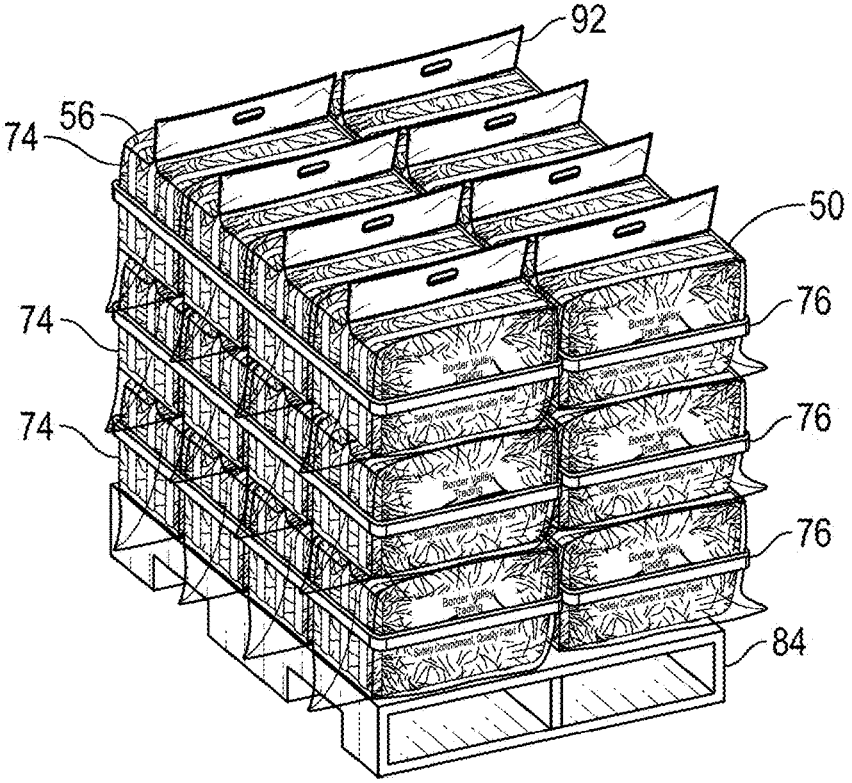
FIG. 2B is an exemplary palletized stack of individually bagged bales formed into banded logs.

The output of the system, in accordance with the exemplary embodiment, is a palletized stack of banded logs 74, where each banded log 74 contains multiple, individually packaged ½ cut bales 50 such as shown in FIG. 2B (showing four bales). Just as each ½ cut bale has one or more plastic straps 56 around the ends 52 to hold the hay together (see FIG. 1A), each banded log 74 has a (usually thicker) plastic band 76 around its length to hold the ½ cut bales in place and tightly together. The quantity of bales 50 in a log 74, and the quantity of logs 74 on a pallet 84, may vary depending on operator preferences, but Applicants have found that using four ½ cut bales per log, with two logs positioned next two each other, stacked three logs high (for a total of six banded logs 74, or twenty-four individually wrapped ½ cut bales) makes for a stable and efficient solution for shipping and handling. This is what is shown in FIG. 2B. Slip sheets (not shown) may be placed on top of the pallet before loading the bales, and also on top of the load of bales, to help protect against intrusion. If desired, slip sheets may also be placed in between the levels of banded logs. As discussed further below, slip sheets can be, for example, a cardboard ply placed on either side of each level (4 slip sheets per stack palletized stack, in the case of FIG. 2B). The slip sheets further help keep moisture out during shipping.

FIG. 2A depicts a single ½ cut bale 50 sealed in a container bag 90 and prepared according to an exemplary version of the disclosed system. As seen, the bag is closed, but not vacuum sealed. That is, preferably air remains in the bag 90 and can also pass in and out of the bag. Such a "breathable" container bag will allow moisture to escape from the hay or other product, helping prevent decay. Container bags can be made of, for example, perforated plastic or other polypropylene. Nearly all bale-worthy organic material contains some liquid when first cut, and may be damp or even wet. It can take days or even weeks for the material to dry out once formed into bales, and the process is slowed when double compressed. It will eventually dry though, so long as it has access to air. There may be little or no access to air when the material is packed for shipping, but when unpacked and sold, the ½ cut bales 50 can dry out in the air-permeable container bags 90.

Each container bag 90, comes with a pre-existing top flap 92 having a U-shaped handle 94 punched in it. The flap 94 identifies the "top" of the bag, and is used for carrying. Downward from the flap extends sides 96 of the bag that, when held open, generally form a square or rectangular housing to receive a bale. The bottom of the bag is initially opened to receive a bale, but is sealed along a bottom edge or lip 98 once a bale is inserted. The bags are clear, or generally clear, so that customers can see the contents within the bag. A label 99 may be affixed to one of the sides as shown. While air permeable, the container bags 90 are of a relatively thick material so as to provide the necessary structure to carry their cargo. Bag thickness is measured in mils, where a mil is $1/1000^{th}$ of an inch. The term "gauge" is also used, where 100 gauge=1 mil. Preferably, the container bags are perforated plastic between five and eight mils thick, and ideally about six mils thick. The perforations are small and comprise only a minor portion of the surface area so as not to weaken the structure. The flap 92 on top is a double-ply of the same material, so ideally about twelve mils thick and two to four inches in height. This prevents the plastic from tearing when the top hole is used as a handle 94. The bottom seal 98 is also overlapping, so it has twice the thickness of the sides 96.

Figure 3:
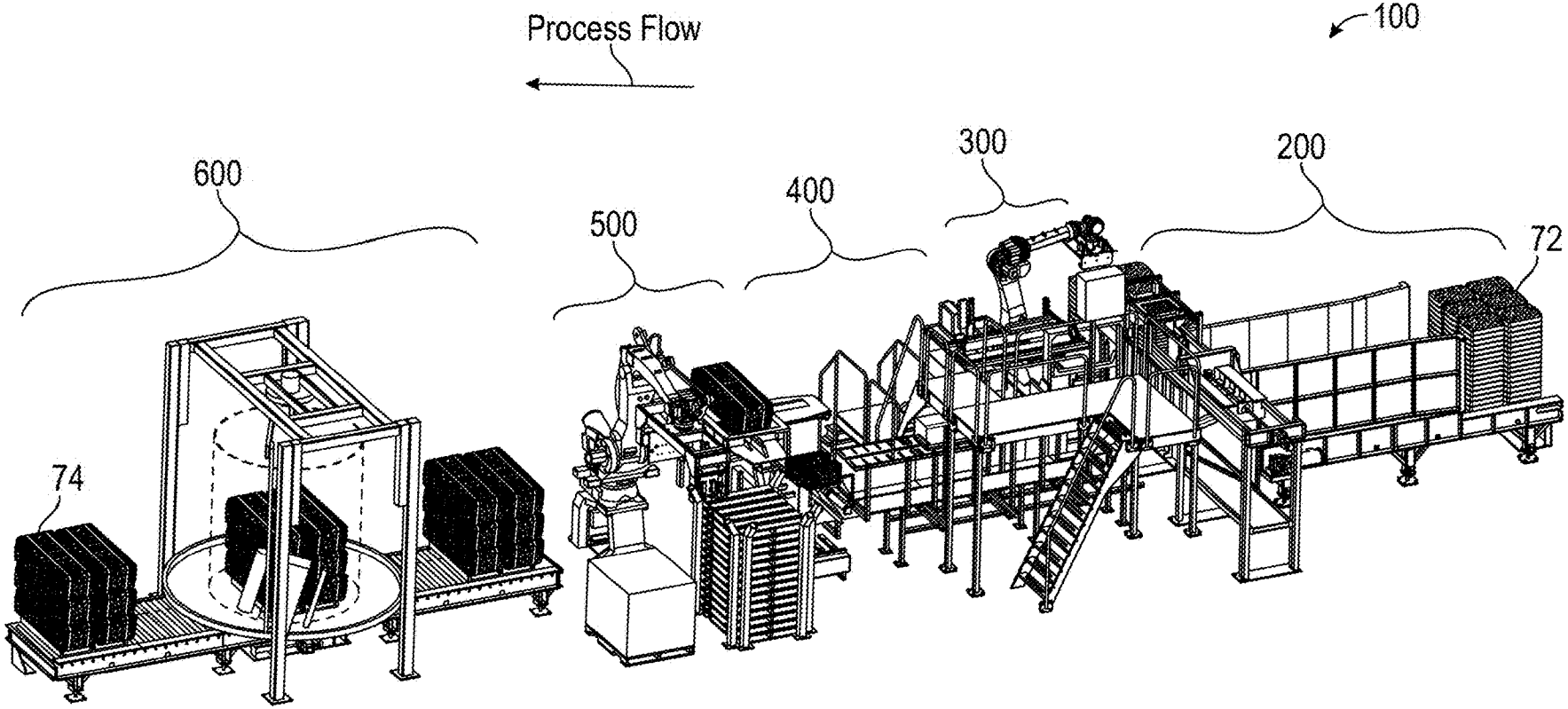
FIG. 3 is an isometric view from the left side of a full bale packing assembly, in accordance with a particular embodiment.
Figure 3A:
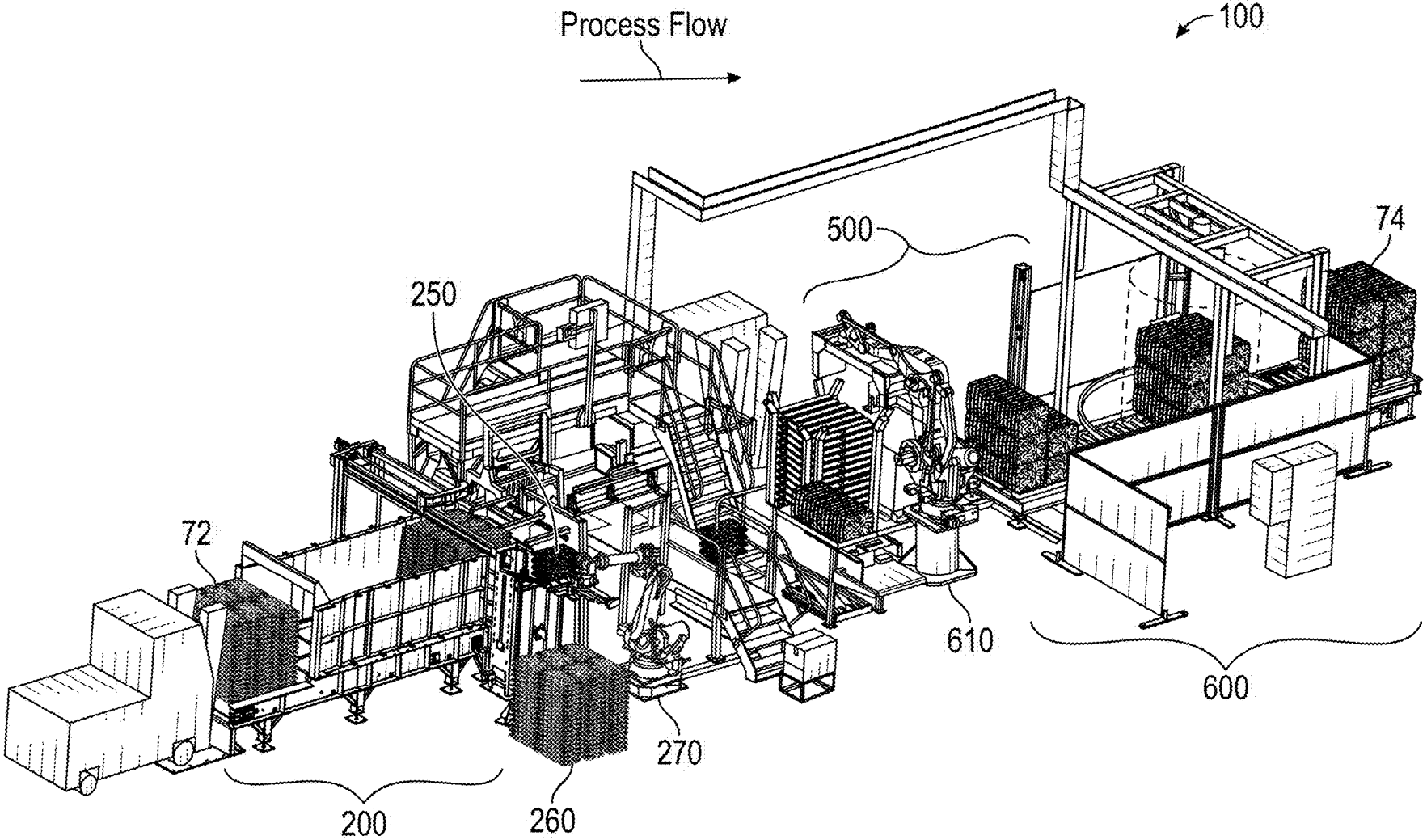
FIG. 3A is an isometric view from the right side of the full bale packing assembly of FIG. 3.

FIG. 3 provides a plan view of an entire bale packing assembly 100 according to certain embodiments taken from a first side (arbitrarily, the "left" side), such that process flow is from right to left. The process, as described in detail through the various figures, is shown at a high level in the flowchart of FIG. 21, which will be referenced herein. As shown in FIG. 3, unbanded receiving logs 72 arrive on the right side and leave as palletized, banded logs 74 of individually packaged bales 50 on the left side. As more fully discussed below, the assembly process is broken down into various stations or sections, namely, destacking station 200, bagging station 300, sealing station 400, log assembly 500, and stacking and wrapping 600. The entire system is fully automated and involves no human manipulation. As disclosed, it involves only two manipulating robots: bag loading robot 270 and stacking robot 610. For clarity, FIG. 3A shows the same assembly, with some of the sections generally marked, from the opposite side. Here, the unbanded receiving logs 72 enter from the left and proceed to ready-to-ship, stacked, bagged and palletized banded logs 74 on the right.

Figure 4:
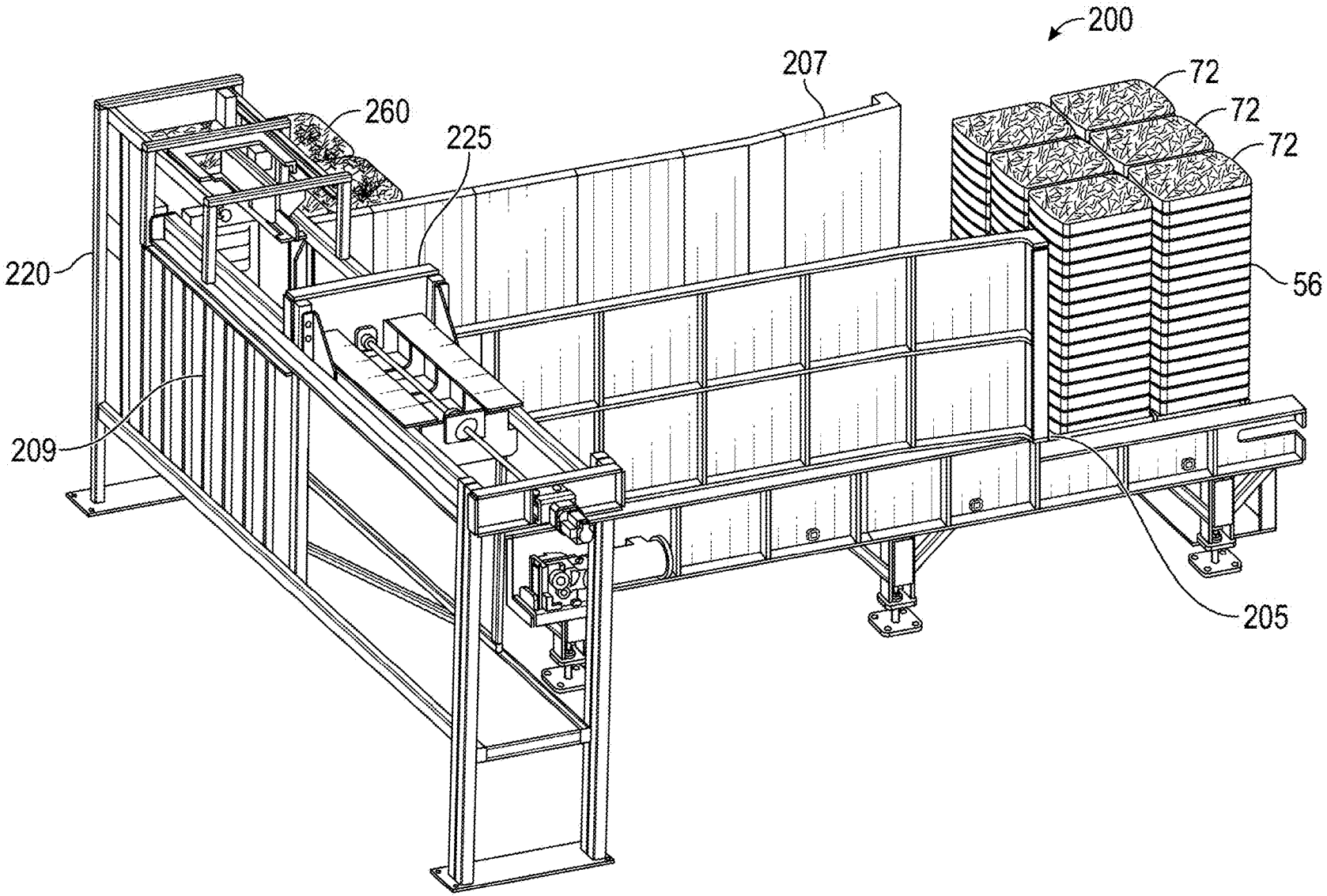
FIG. 4 is a plan view a destacking station of the bale packing assembly of FIG. 3.
Figure 21:
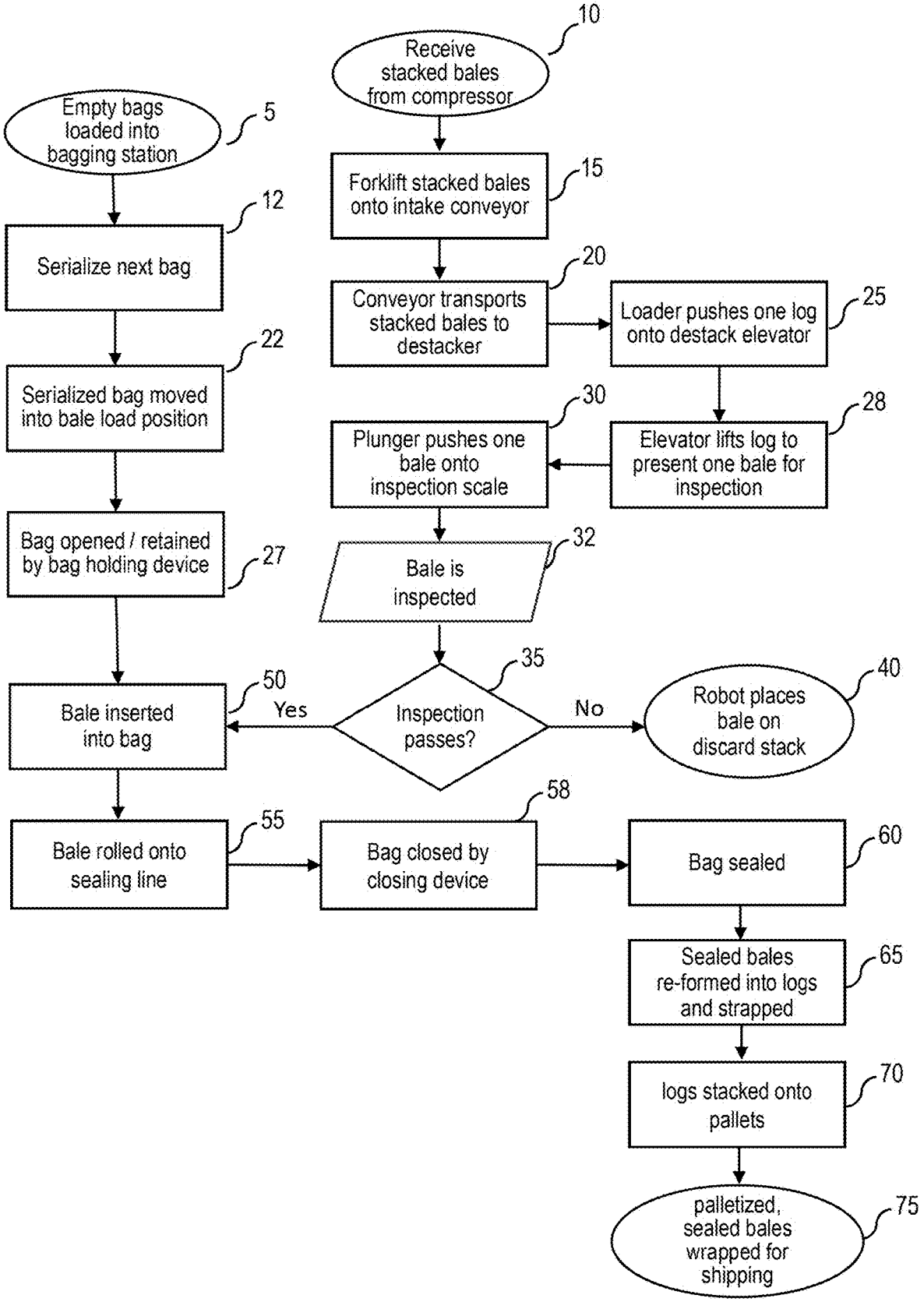
FIG. 21 is a flow chart illustrating certain steps of a bale packing process, according to certain embodiments.

FIG. 4 shows an isometric view of the destacking station 200 from the left side. Unbanded receiving logs 72 are received from a hay press (FIG. 21, Step 10) and are loaded onto a moveable intake conveyor belt 205, such as with a fork lift (FIG. 21, Step 15). At this point, the ½ cut bales 50 that make up the logs are not bagged, but each bale does have plastic straps 56 around them to hold them together. These straps are left in place throughout the entire process and can help illustrate how the bales are manipulated as they move along. While the bales could be individually placed on the conveyor belt 205, the illustrated embodiment allows them to remain in logs 72, standing on end. The receiving logs 72 are not banded, allowing individual bales to be removed from the logs. As shown, there are six logs 72 introduced as a group, for a total of 24 bales.

As the group moves along the conveyor belt 205 from right to left, it is guided by intake guiderails 207 to prevent spillage and to center up the group on the belt for automatic manipulation (FIG. 21, Step 20). Position sensors (not shown) are used to control movement of the belt 205 such that the group stops at the appropriate location. Such sensors are known in the art and may be, for example, triggered by light levels, weight, etc. However, stop wall 209 provides additional structure to line the group up for destacking. Once logs 72 are in position against the stop wall 209, plungers are used to position them on a destacking elevator 220.

Figure 5:
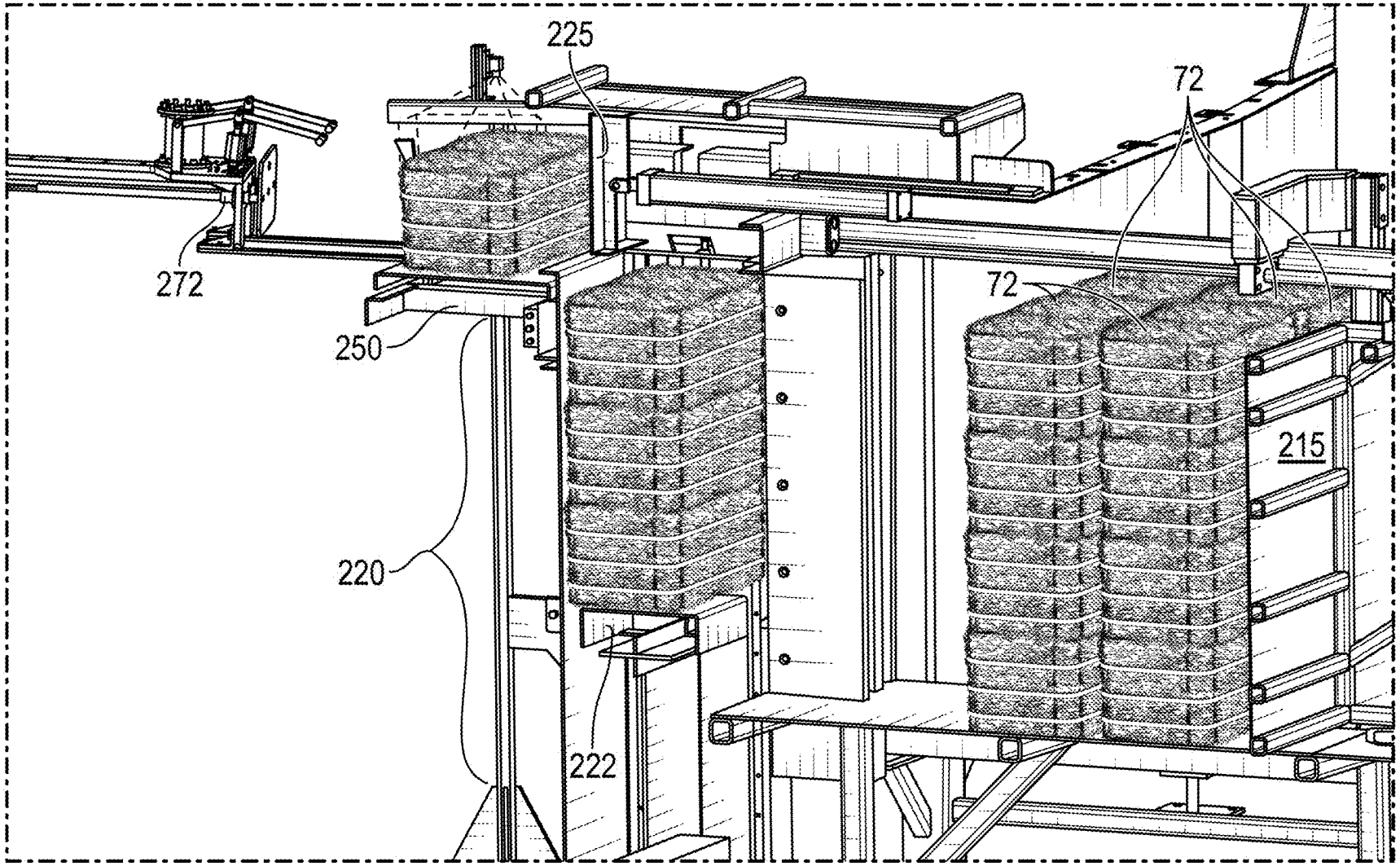
FIG. 5 is a plan view of the destacking station of FIG. 4 with certain components removed.

In FIG. 5, the stop wall 209 has been removed so that the awaiting logs 72 can be seen. To the right is log plunger 215, which is comprised of a shaft fixed to a long plate having surface area approximately equal to the side of the adjacent log. In operation, the shaft presses the log plunger 215 to the left, causing the row of logs aligned with it to move to the left. (FIG. 21, Step 25). This is only done when sensors indicate that elevator platform 222 of the destacking elevator 220 is empty and ready to receive the next unbanded receiving log 72. If this results in no logs remaining in front of the log plunger (or triggered by the log plunger reaching a certain extension point corresponding to the last log being loaded on the platform 222), the plunger retracts to its initial position. Then the presence indicator sensors trigger the conveyor belt 205 to move forward so as to position fresh logs in front of the log plunger. As shown in FIG. 5, a first row has been pressed forward placing the first log 72 of the waiting group of bales on the platform 222.

The destacker elevator 220 operates to position a single ½ cut bale 50 at a particular height for placement on an inspection scale 250. Once loaded with a fresh log 72, the elevator 220 will rise by the approximate height of one bale 50, such that the top bale is now above the other waiting logs 72 (FIG. 21, Step 28). At that point, bale plunger 225 presses the bale over onto the inspection scale 250 to the further left (FIG. 21, Step 30). The bale plunger is a smaller version of the log plunger 215, and similarly is configured with a plate and a shaft that extends a set distance forward. Once the top bale 50 is moved over onto the scale, the bale plunger 225 retracts to its initial position allowing the elevator 220 to raise up by the height of another bale. This process continues until the last ½ cut bale 50 is removed from the destacker elevator 220, at which point the elevator platform 222 is lowered down such that the level of the platform will be even with the intake conveyor belt 205 so as to receive the next unbanded receiving log 72 (via the log press 215).

The destacker elevator 220 can be spring-loaded or lifted with other means such as a pneumatic or hydraulic shaft much like the lateral plungers 215 and 225. Alternatively, it may comprise vertical rods with threading that rotate by way of a servo motor, causing a nut to move at a controlled speed up and down the shaft. In turn, the nuts rest against the bottom of the elevator platform 222, thereby controlling its height. Thus, the destacking station 220 destacks and separates individual bales for inspection from stacked logs in a fully automated manner, and without the use of a manipulating robot. In other embodiments, bales may be manipulated or moved, such as from the top of the destacking elevator or other stages of the process, by a picking machine such as a Fanuc robot. The picking machine can be equipped with pincers to lift the ½ cut bale 50 by its strap 56 or by piercing into the hay. The picking machine then rotates and places the selected ½ cut bale on the inspection scale 250. Of course the inspection station 250 must be emptied each time before receiving a new bale. This function is performed by a manipulating robot in the illustrated embodiment, as described below.

Figure 9:
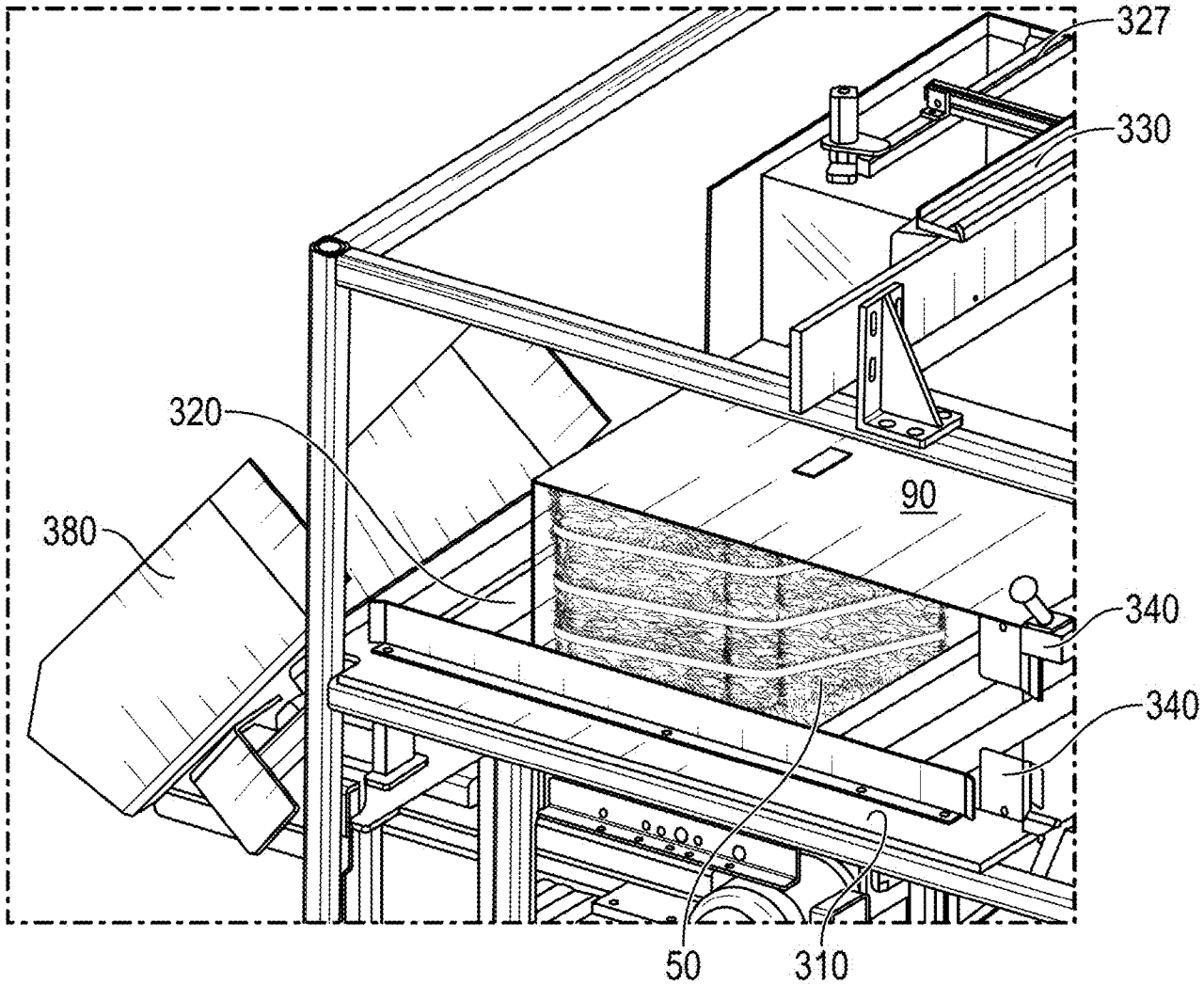
FIG. 9 is a second plan view of the bagging station of FIG. 8, with emphasis on the bale chute.

The bale 50 that has been pushed off destacker elevator 220 and onto the inspection scale 250 is inspected by the system for various parameters such as weight, shape and presence of straps 56 (step 32 of FIG. 9). The specific features to be inspected and the specific parameters to be considered a pass are adjustable by an operator, but the system automatically will look for the operator's pre-set parameters for each feature to be considered. If the bale being inspected has a feature outside of the pre-set parameters, it will be rejected.

The inspection station can be configured with various equipment to ensure the selected ½ cut bale is suitable for bagging. For example, the inspection station may contain a scale such as inspection scale 250 to ensure the bale is within an accepted weight range, such as from 40 lbs. to 60 lbs. As shown more clearly in FIG. 6, the station may also be equipped with cameras 254, lighting 256, or a laser inspection system to detect the shape and size of the bale, and possibly the presence of the plastic straps 56. This will prevent the system from attempting to load a bale that has been damaged, lost a strap, or is otherwise misshapen such that it won't fit well within a container bag 90. The shape is also important to make sure the ½ cut bale will stack appropriately into logs for shipping. These and other parameters can be automatically set or adjusted by a system operator. Information from the camera, scale and/or other sensors is passed to a processor that is programmed to determine (FIG. 21, Step 35) whether the ½ cut bale 50 has passed inspection.

If a bale does not pass inspection, it is removed from the inspection scale 250 and placed to the side in a re-work stack 260, as shown best in FIG. 3A. (FIG. 21, Step 40). From there, the bale may be sent back to the hay compressor where it will be disassembled and repacked into a new ½ cut bale. If the inspection passes, the processor directs the system to proceed to bagging.

Figure 6:
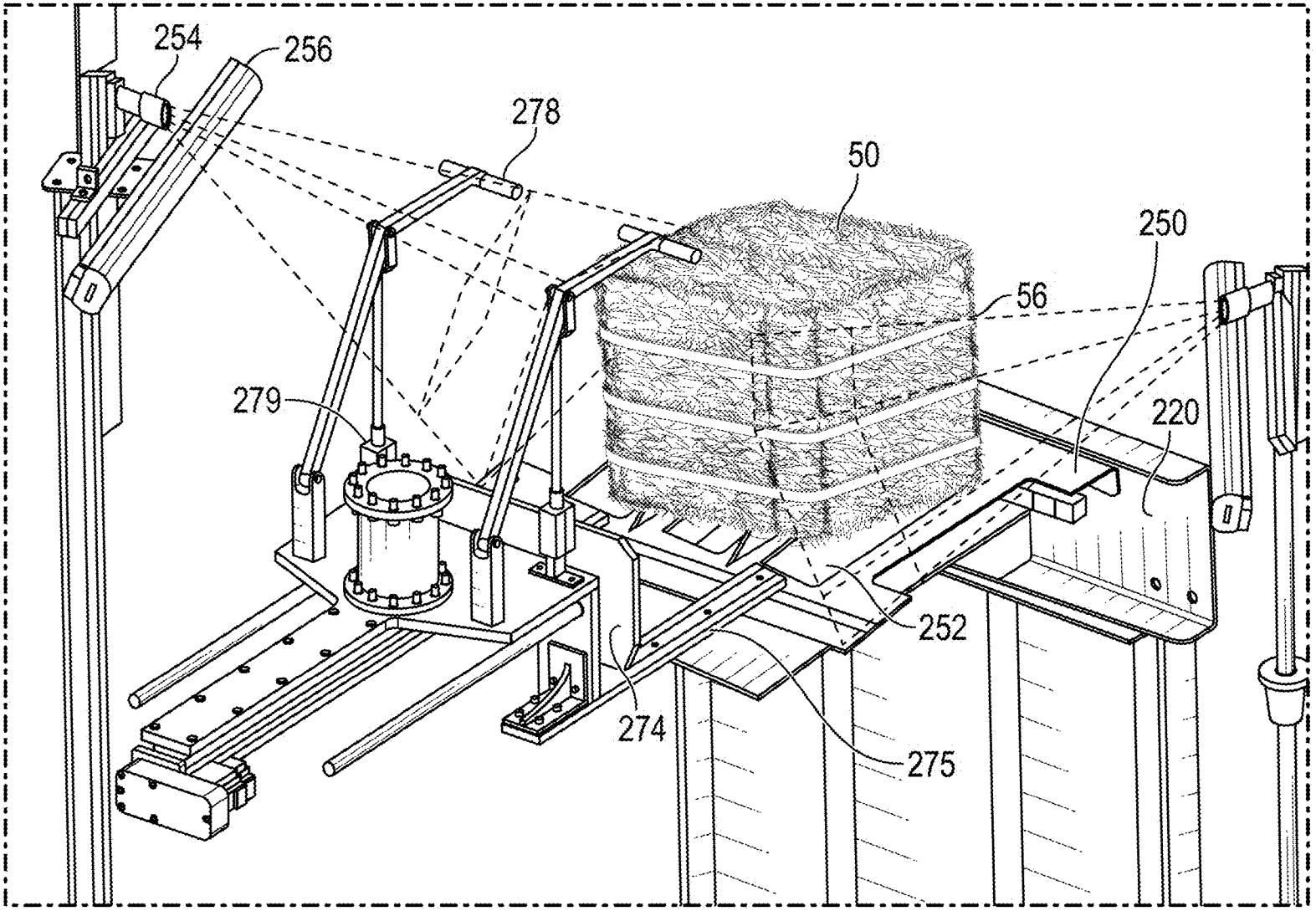
FIG. 6 is a view of an inspection portion of the destacking station of FIG. 4.
Figure 7:
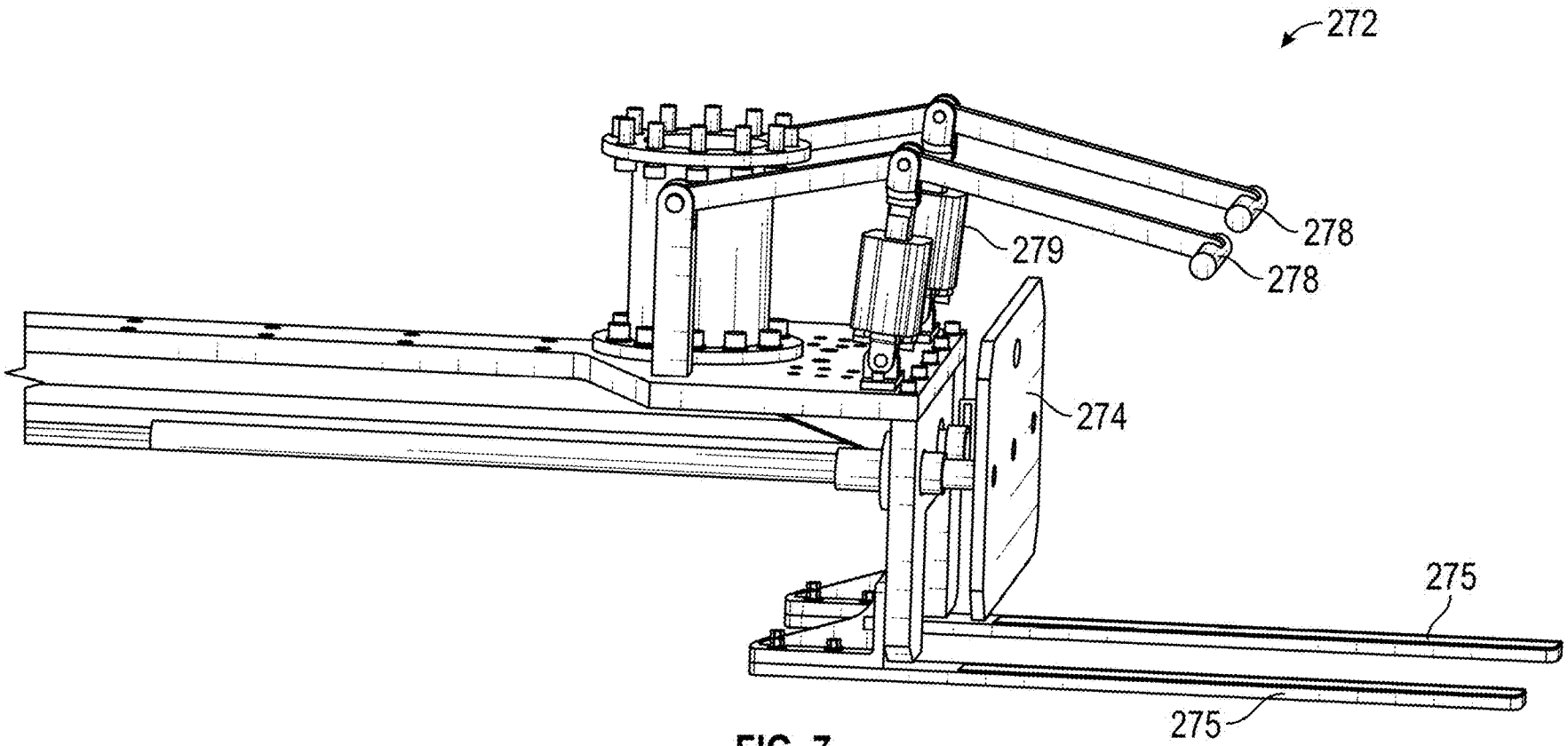
FIG. 7 is an isolated view of a bale handler tool in accordance with certain embodiments.

As illustrated, removal of the bale 50 from the inspection station is performed by a bag loading robot 270. The robot 270 is shown clearly in FIG. 3A, but the robot itself is a standard manipulating robot such as a R-2000 series robot from Fanuc. The custom component of the robot is the portion designed to grasp and manipulate the bales (bale handler 272), which is shown in FIGS. 6 and 7. As shown, bale handler 272 mounts on the end of the robot and comprises a plunger 274, top clamps 278, and a set of forks 275 that extend underneath a bale 50. The forks 275 fit into grooves 252 in the inspection scale that extend beneath the surface of a bale when loaded on the scale 250. As the forks 275 are inserted into the grooves 252 by the bag loading robot 270, actuators 279 extend raising top clamps 278 above the height of the bale 50. Once the bale is fully seated against the plunger 274, the actuators 279 retract, pressing the top clamps 278 against the bale and holding it down against the forks 275. From this point, the robot 270 can remove the bale 50 from the scale 250 and move it to either the rework stack 260 or into a bag (FIG. 21, Step 50) as described further below.

Figure 8:
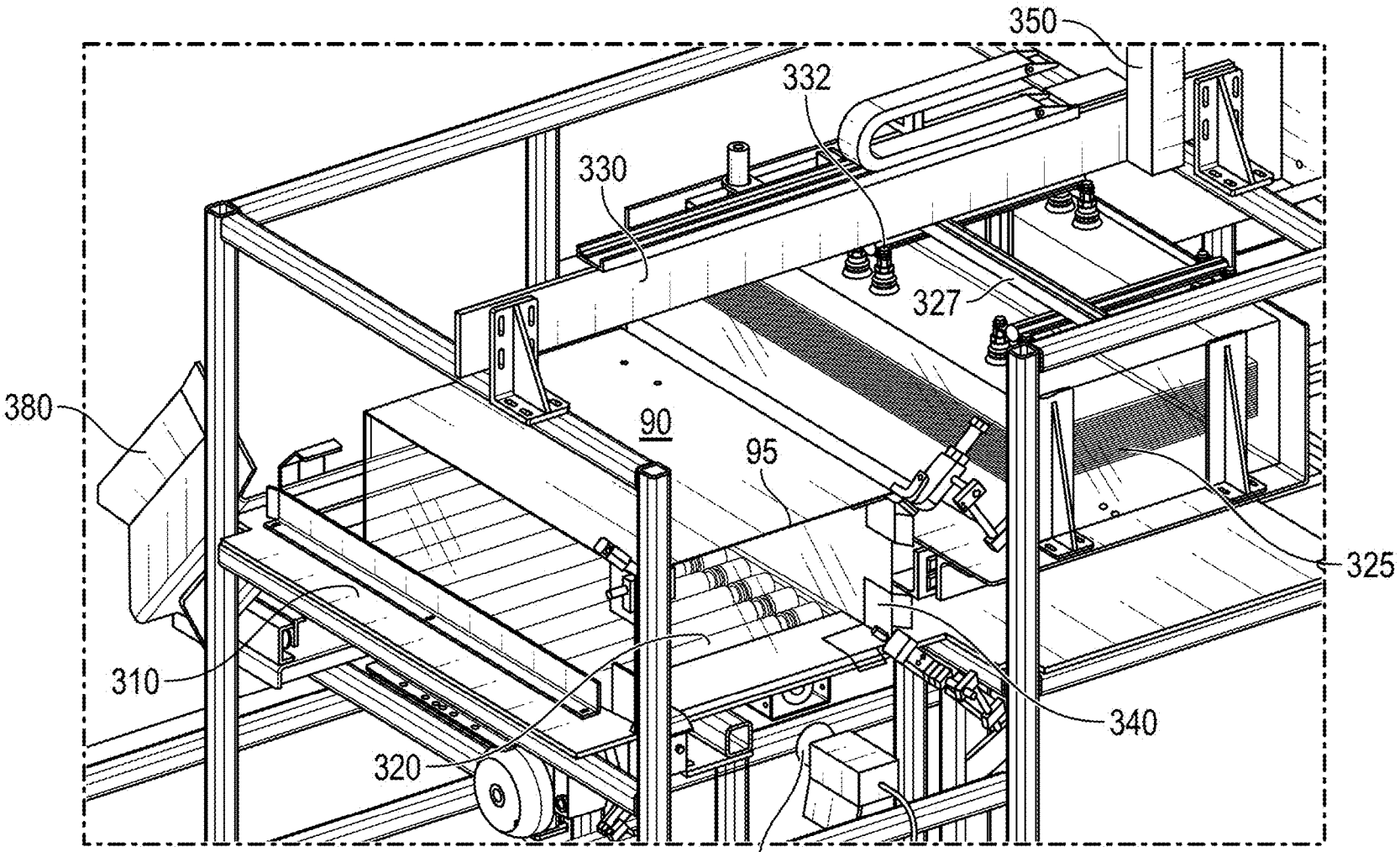
FIG. 8 is a plan view of the bagging station of the bale packing assembly of FIG. 3.

While the bales are being destacked and inspected at destacking station 200, a separate part of the process is operating at the bagging station 300. Turning to FIG. 8, this process begins at bag stack 325, which is a stack of empty bags 90 that are flattened out on top of one another. Recall that the bags 90 already have the double-ply top flap 92, and are opened at the bottom because sealed bottom edge 98 is not yet formed. The system comprises a bag serializer 350 positioned over bag stack 325. The serializer has a printing component that drops down and places serialized data on the top bag 90. (FIG. 21, Step 12). This data may be received from or sent to a processor that tracks and controls the operation, as discussed below. The serialized data may contain various information that is selected by a system operator such as, for example, a numerical sequence and a time stamp to identify the date on which the bale was packaged. The data may be in the form of a bar code or QR code such that it is machine readable, or may be printed for human reading. The data may also contain information such as temperature, moisture content, or other factors describing the environment in which it was packed. It may also contain a lot number for shipping purposes or information about the customer to which it has been purchased.

Figure 22:
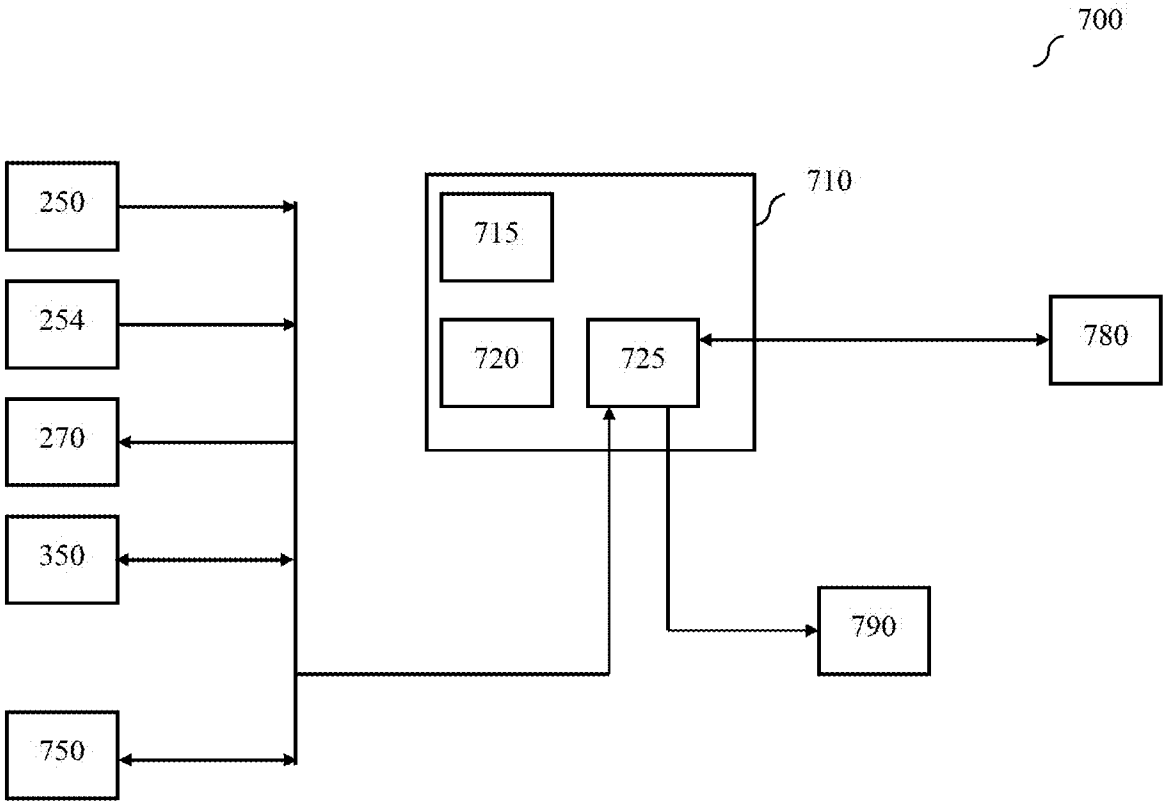
FIG. 22 is a block diagram illustrating connections between control features of a bale packing process.

Once the top bag 90 is serialized, a frame 327 comprising suction cups 332 lowers down and presses against the top bag causing the bag's top surface to adhere to the suction cups. As the frame 327 lifts back up, the bottom surface of the bag 90 droops away at the open end 95. The frame 327 then moves laterally (to the left in FIG. 8) along gantry 330 to the bale load position over bagging platform 310. (FIG. 22, Step 22). Note that the position of the bag 90 is now such that its top flap 92 is facing away from the open end 95. To fully open the bag 90, a pneumatic nozzle 360 rises up so as to be in line with the open end of the bag 90 and releases a short blast of air into the opening to rapidly expand and fully open the bag. While the air is blowing, bag corner holders 340 rotate into position, each catching the open end of the bag and holding it fully open.

Figure 8A:
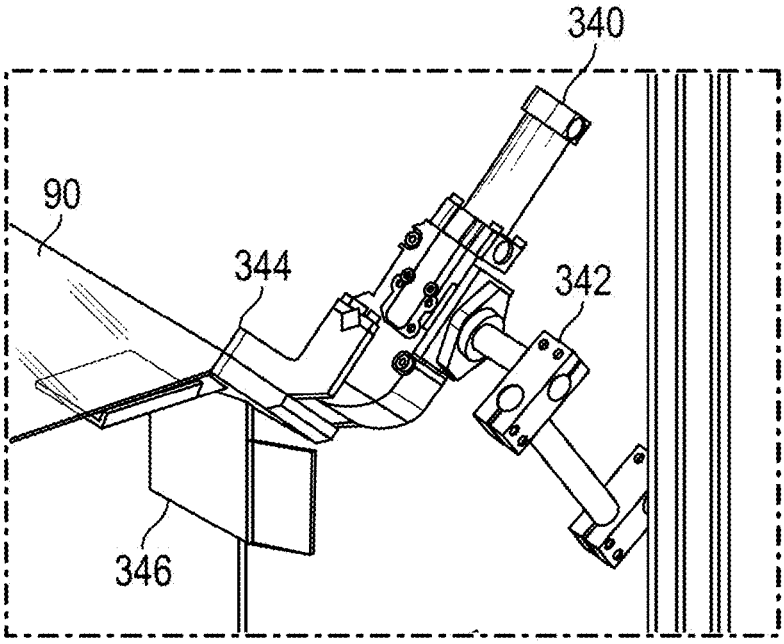
FIG. 8A is an isolation view of a bag corner holder in a first position.
Figure 8B:
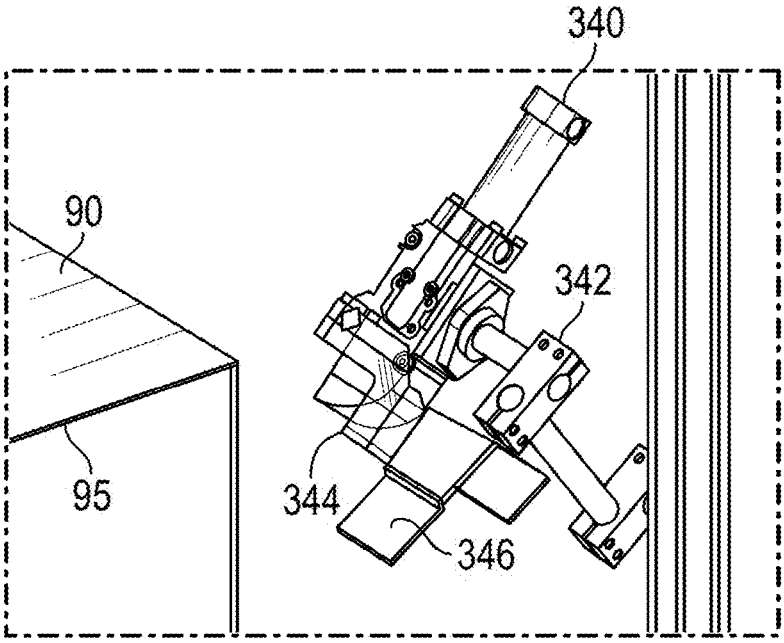
FIG. 8B is an isolation view of a bag corner holder in a second position.

In the illustrated embodiment, and as shown more clearly in FIGS. 8A and 8B, each corner holder is comprised of a base 342 connected to a fixed support structure, a rocker arm 344 that extends out roughly 90 degrees from a retracted position, and a convex gripping plate 346 configured to grip the inner surface of the bag 90 at its open end 95. When the bag 90 is in place and opened with the blast of air, the rocker arms 344 of the four corner holders 340 rock forward (i.e., from the position in FIG. 8B to the position in FIG. 8A), such that the gripping plates 346 catch the inner surface of the bag 90 and hold it completely open into approximately a rectangular opening sized larger than the circumference of a bale 50 to allow for loading. (FIG. 21, Step 27). In some embodiments the gripping plates simply stretch the bag outward to hold it in place. In other embodiments, the corner holders 340 may also comprise clamps (not shown) that close around the outer surface of the bag 90 to press against the gripping plates to help hold the bag in place as it is loaded.

With the serialized bag 90 held in this position, bag loading robot 270 inserts a bale 50 that has passed inspection into the open end 95 using the bale handler 272. Once in the bag, the plunger 274 against which the bale 50 is positioned presses forward at roughly the same rate that the bag loading robot retracts the bale handler 272 from the inside of the bag. As a result, the plunger 274 essentially holds its position relative to the bag 90, and likewise keeps the bale 50 in its inserted position, thereby depositing the bale 50 fully inside the bag 90 as the bale handler tool 272 is extracted. The weight of the bale, now removed from the forks 275 of the bale handler 272, drops down slightly so as to be supported by rollers 320 that form the base of bagging platform 310. This also causes suction cups 332 to release from the top surface of the bag 90, and the frame 327 returns along the gantry 330 to its original position, ready to retrieve another empty bag. In addition, the rocker arms 344 of the bag corner holders 340 rock back, exiting the bag and releasing the edges of the open end 95. The bag 90 is now resting on the bagging platform with the bale 50 fully inside it.

From here, the now-bagged bale is moved rearward toward the bale chute 350. In some embodiments, one or more of the rollers 320 are driven rollers such that they rotate and move the bale 50 rearward and down the chute 350. In other embodiments, the bag loading robot 270 raises the bale handler 272 slightly such that the forks 275 align with the center of the bale 50 and then presses the bale handler 272 forward, pushing the bagged bale 50 toward and down the chute before returning to its position at the inspection station 250 to receive the next bale. In either case, the bagged bale 50 slides down the bale chute 380, landing on the seal conveyor 405 with its top flap 92 facing down, and the open end of the bag 95 facing up. (FIG. 21, Step 55).

Figure 12:
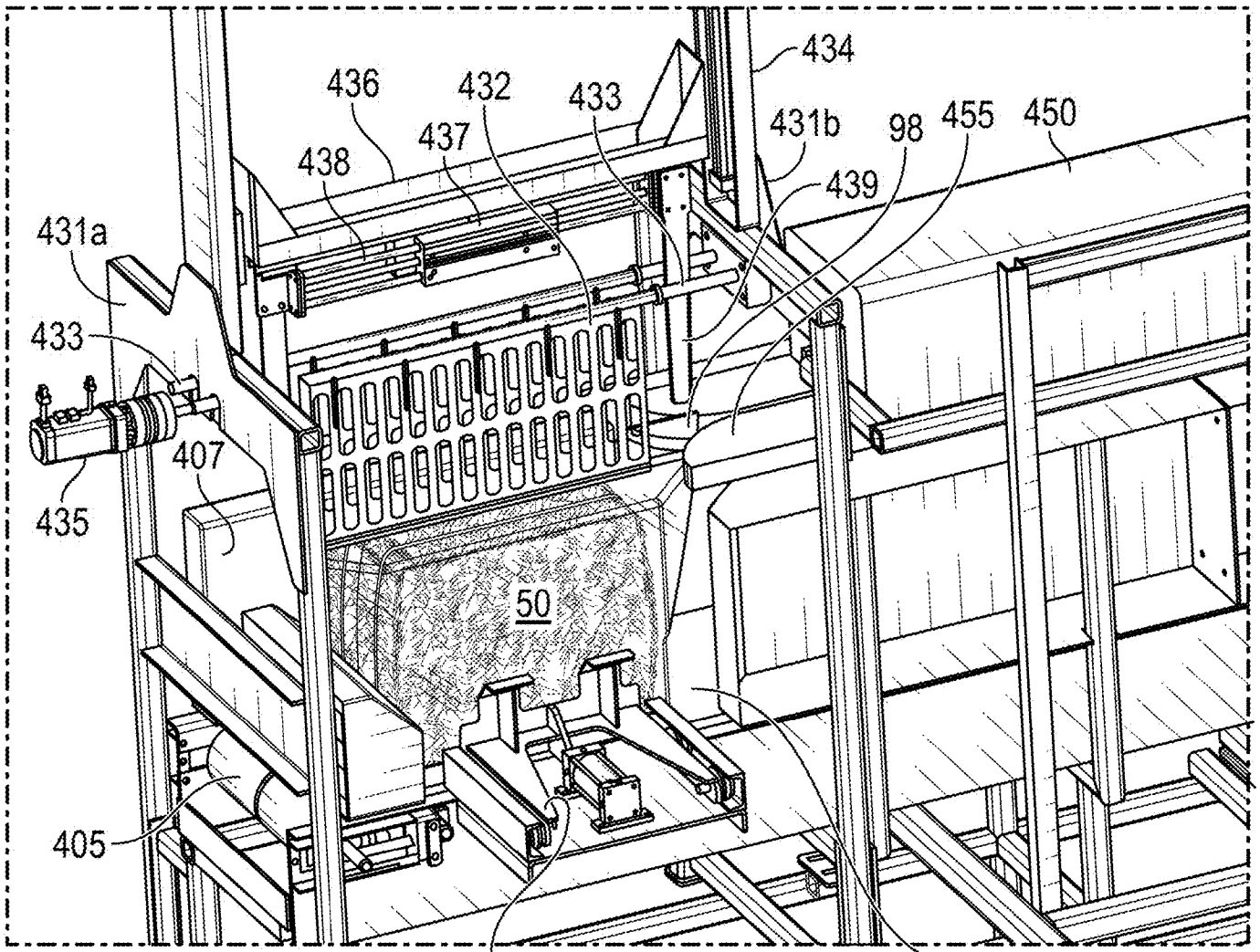
FIG. 12 is a partial view of the sealing line of FIG. 10, with the closing assembly in a closed position.

The bale chute 380 is best illustrated in FIG. 9. The sealing line 405 is not shown in that image, but the bale comes to rest approximately in the position it is shown in FIG. 12. In FIG. 12, bale alignment clamp has been extended forward, but it is retracted away from the illustrated bale position when the bale 50 arrives down the chute 380. Bracing wall 407 provides a backstop to prevent the bale 50 from rolling off the seal conveyor 405 once it drops in off the chute 380. As soon as the bale arrives, bale alignment clamp 410 shifts forward, aligning the bale 50 at the center of the conveyor 405, and preventing it from rebounding off the bracing wall 407 and off the near side of the sealing line 400.

Figure 10:
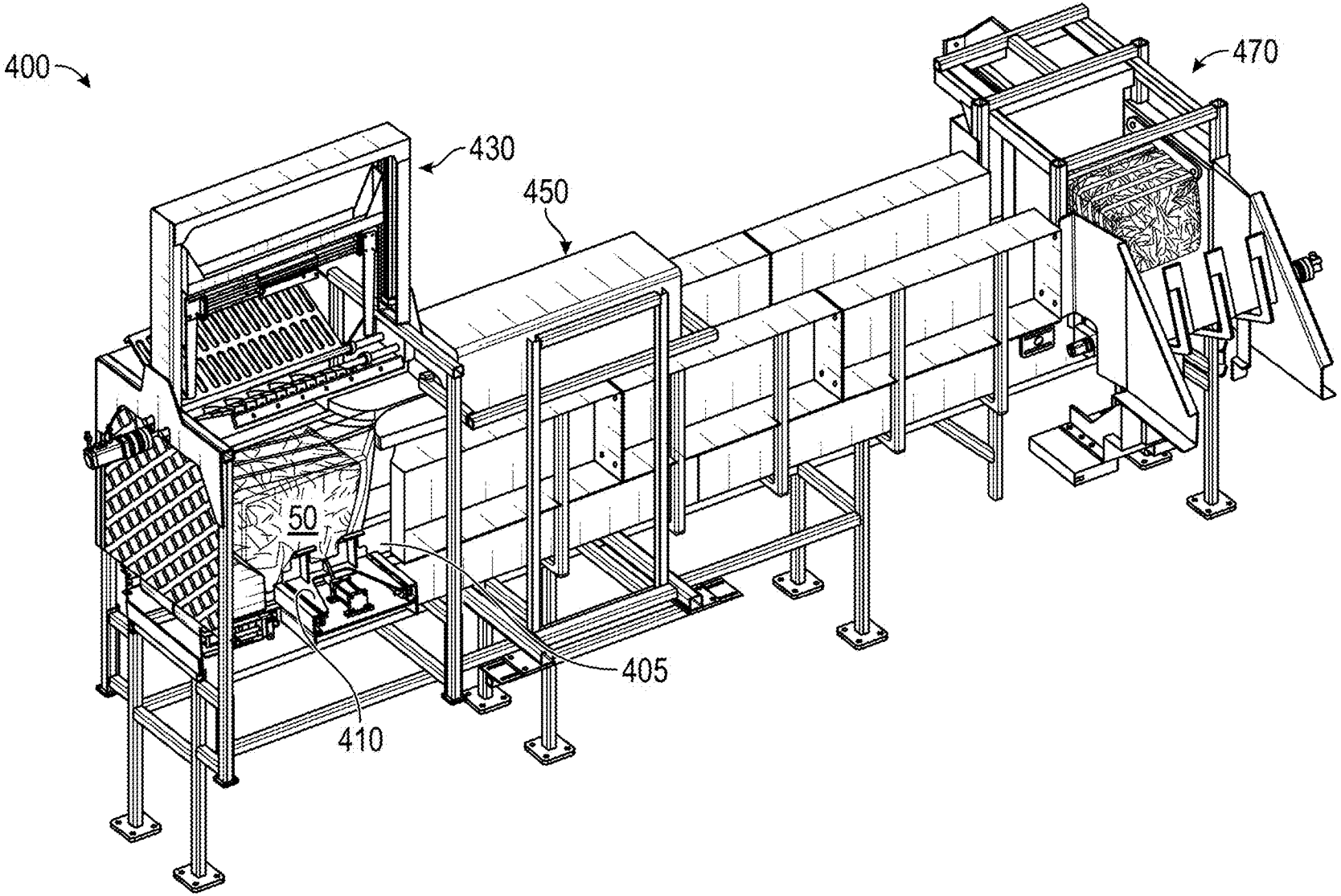
FIG. 10 is a plan view of the sealing line of the bale packing assembly of FIG. 3.
Figure 11:
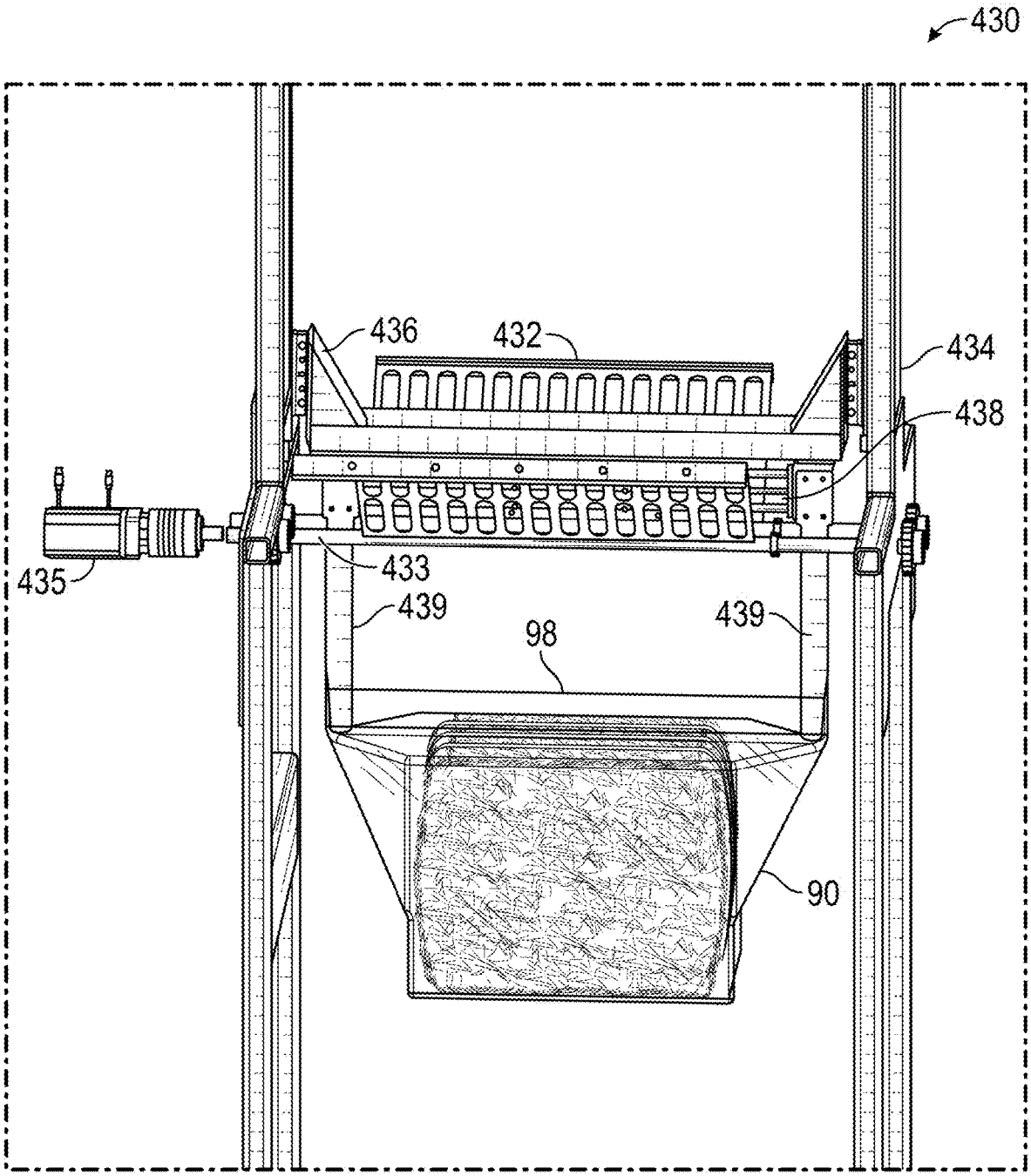
FIG. 11 is an isolated view of components of a closing assembly component of the sealing line of FIG. 10.

FIG. 10 shows a view of the full sealing line 400 of the double compressed bale packing assembly 100. The sealing line 400 is comprised of three principle components: closing assembly 430, heat sealer 450, and bale flip 470. FIG. 11 shows an isolated view of the key components of the first of these—the closing assembly 430. Before the open end 95 of the bag 90 can be sealed, it first must be drawn together (closed). Now that the bag 90 is top flap down on the sealing conveyor 405 (not shown in this image, but present) such that the bottom of the bag is facing upward, exposed and unweighted, this operation may be performed. The closing assembly 430 comprises a frame structure with two sides (431*a*, 431*b*) each supporting a vertical rail 434 extending upward. At the bottom of the rails 434 are two gate rods 433 that extend across from one rail to the other. (See also FIG. 12). Fixed to each gate rod 433 is a clamp gate 432 that swings from open positions (FIG. 11) to closed positions (FIG. 12) as the gate rods 433 rotate. The gate rod rotation may be controlled by a servo motor 435.

Also extending between the rails is beam 436. However, unlike the gate rods 433, which do not move along the rails 434, beam 436 does move up and down rails 434. It's movement can be controlled by a servo motor positioned at the top of the rails 434 (not shown). Extending down from the beam 436 are two paddles 439 that travel laterally along paddle rods 438 driven by a pneumatic cylinder 437. The paddle rods fit in between and travel along a path between the two gate rods 433, as best shown in FIG. 12. Originally, the beam 436 is withdrawn up toward the top of rails 434. Once a bag is positioned on the seal conveyor 405, beam 436 drops down the rails with paddles 439 shifted in toward the center of the closing assembly 430. As the paddles 439 drop down into the open end 95 of the bag, the frame 436 stops and the paddles 439 move outward along the paddle rods 438, pulling the open end of the bag 95 shut and forming what will become the sealed bottom edge.

In the preferred embodiment, the paddles 439 are extended wide enough that clamp gates 432 swing closed in between them, pressing the edges of open end 95 together along a straight line, full closing the bag 90. (FIG. 21, Step 58). The beam 436 then raises back up along the rails 434, retracting the paddles 439 from the open end 95 of the bag. This position is best illustrated in FIG. 12. Once in this position, the controlling processor sends signals to activate sealing conveyor 405 to move the bagged bale 50 toward and through the heat sealer 450. As it does so, the leading edge of the bag 90 moves into feeding channel 455. Though paddle 439 has been removed, the closed clamp gates 432 are positioned close enough to the entrance of the feeding channel that, given the thick gauge of the bag material, the end is still substantially closed together and does not gap. The clamp gate does not move as the bag is pulled through it along the sealing conveyor 405. Ideally, the edge of the clamp gate that comes into contact with the bag is fitted with rollers or bearings sufficient to apply pressure and keep the bag open end 95 closed, but allow it to easily traverse into the feeding channel 455 of the heat sealer.

As the bale 50 passes along sealing conveyor 405 underneath the heat sealer 450, heat is directly applied only to the outer edges of what was the open end 95 of the bag 90. This melts the ends together, forming sealed bottom edge 98. (FIG. 21, Step 60). Once passing through the sealer 450, the bale 50 is fully closed within the bag 90. But the bag 90 is still upside down.

Figure 13A:
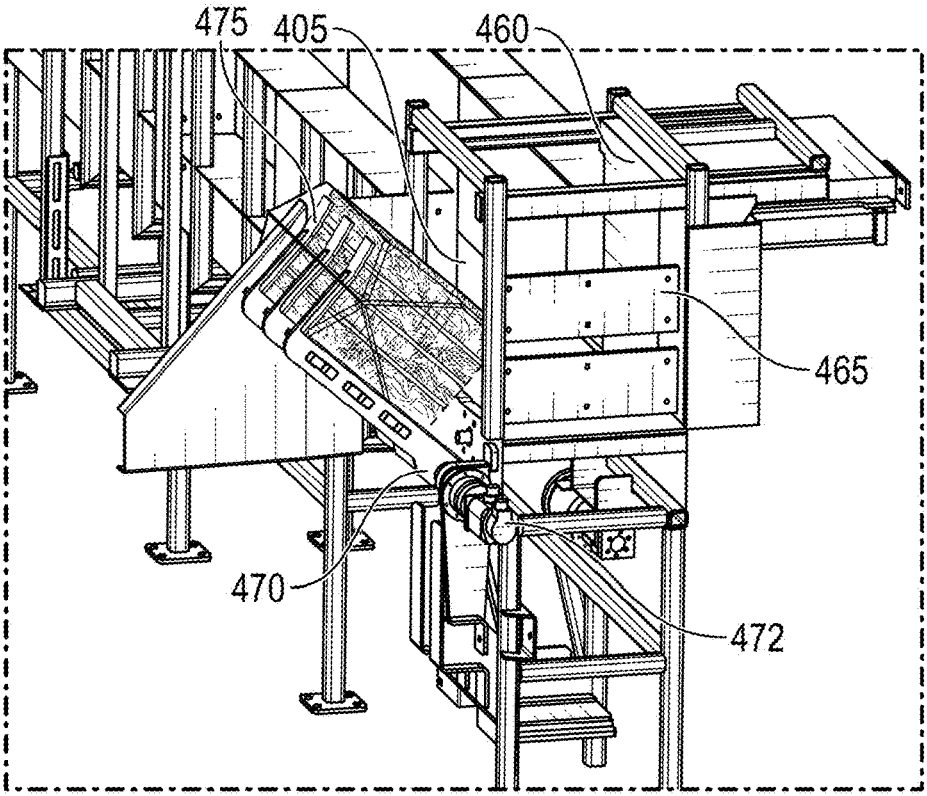
FIG. 13A is a partial view of the end of the sealing line of FIG. 10, with a bale flip in a first position.
Figure 13B:
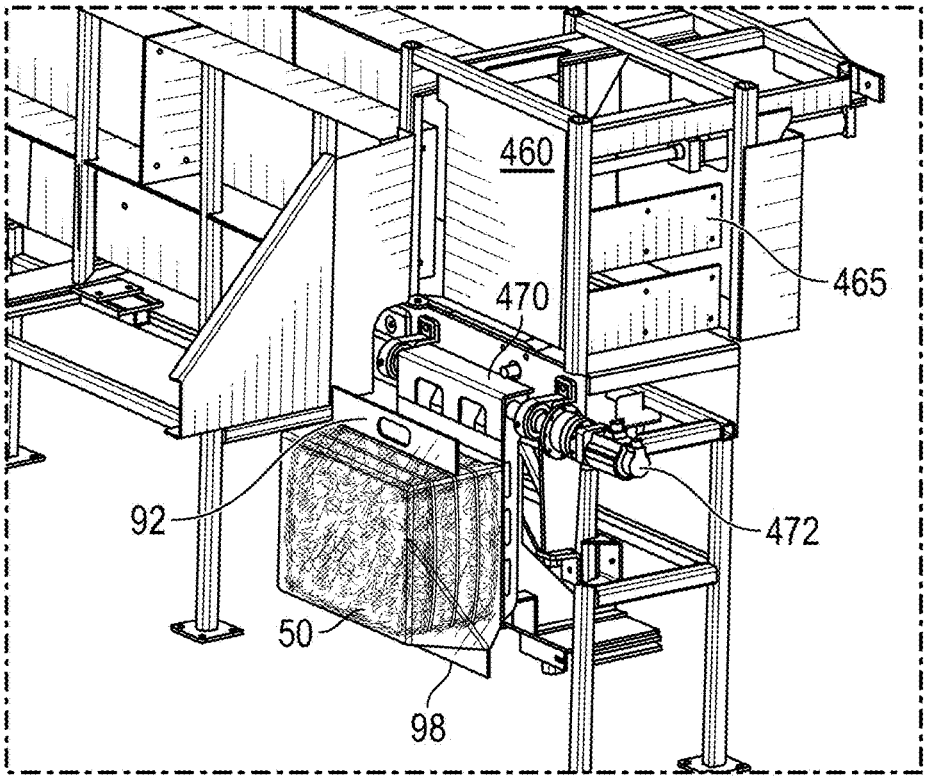
FIG. 13B is a partial view of the end of the sealing line of FIG. 10, with a bale flip in a first position.

Turning to FIGS. 13A and 13B, at the end of the sealing line 410, the bale 50 reaches an end barrier 465. Flush against its right side is bale flip loading press 460. This press 460 prevents movement as bale flip 470 (driven by servo motor 472) swings up against the bale's left side, and positioning supports 475 over its top (e.g., the sealed bottom of bag 90). From here, the servo 472 rotates the bale flip 470 back slowly as bale flip loading press 460 shifts forward across the end of the sealing line, pushing the bagged bale off the line and onto the bale flip 470. FIG. 13A shows this process starting, while FIG. 13B shows the end result—the bagged bale is resting on the supports 475, with top flap 92 facing up and the freshly sealed bottom edge 98 on the bottom. What is not shown in FIG. 13B is that the bale 50 is now positioned directly over rails 510, ready to move to the log assembly 500.

Figure 14:
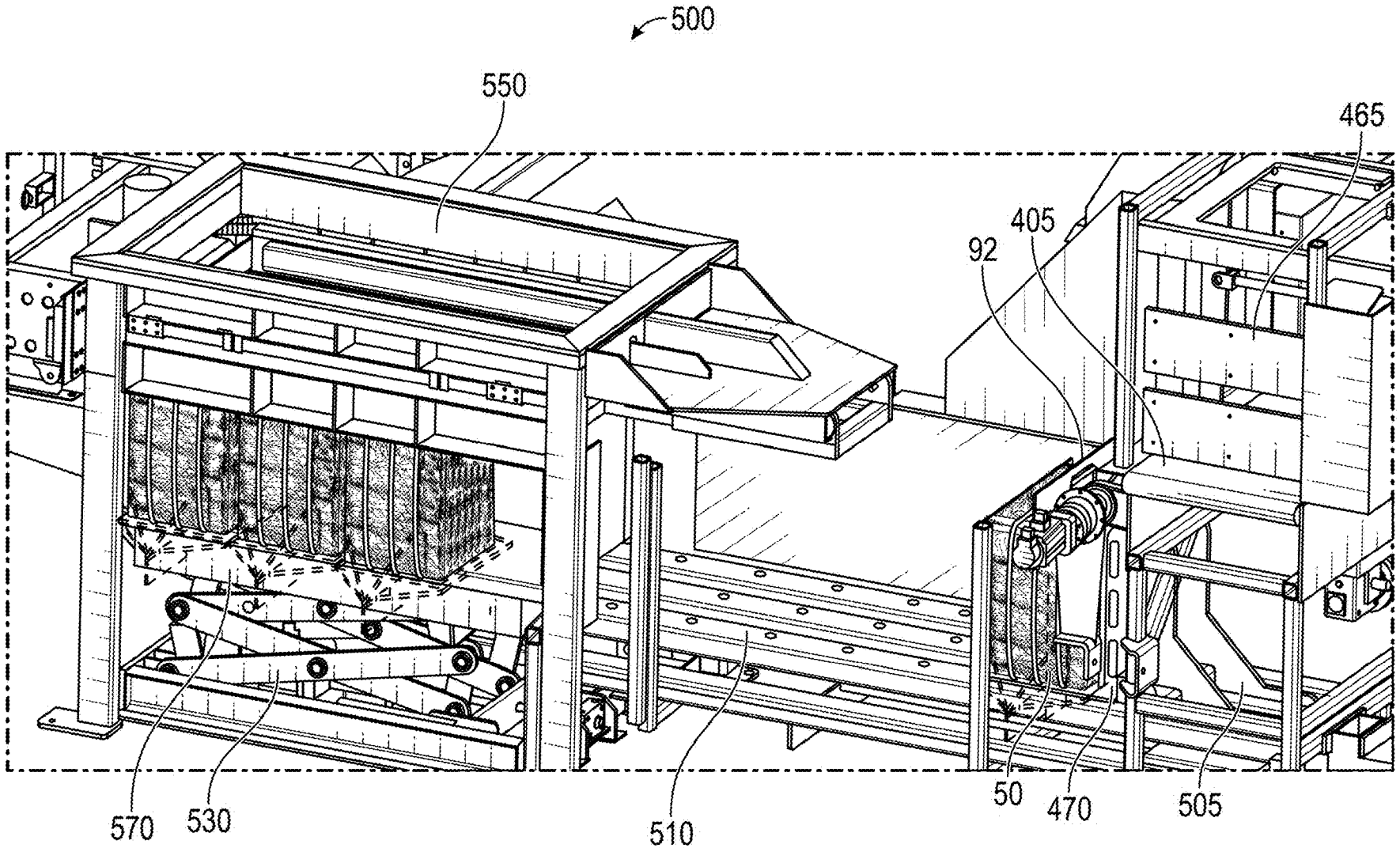
FIG. 14 is a plan view of the log assembly of the bale packing assembly of FIG. 3.

FIG. 14 shows a bag 50 at right, resting on the supports 475 and still seated against bale flip 470. The bale has just been flipped over and now the flap 92 is on top. Underneath the supports are rails 510 extending to the right, and aligned with a log banding platform 570 as shown. Waiting on the banding platform are three other bagged bales 50 that are waiting for a fourth to form a full log. At this point, lateral actuator 505 is driven from right to left, along the rails, pushing the bale 50 on the right at the bale flip 470 along with it. The lateral actuator 505 is configured to fit in between slots formed in the bale flip such that it passes right through and proceeds to the left, pushing the bale 50 along the rails 510 until the bale takes the last remaining position on the banding platform 570. The lateral actuator 505 then retracts to its start position underneath the sealing conveyor 405. Though not show, the lateral actuator 505 is responsible for positioning all four of the bales 50 onto the banding platform 570 one at a time. A backstop (not shown) is provided on the right of the banding platform that prevents bales from being pushed off the end and allowing the lateral actuator 505 to push them snuggly together.

Figure 15:
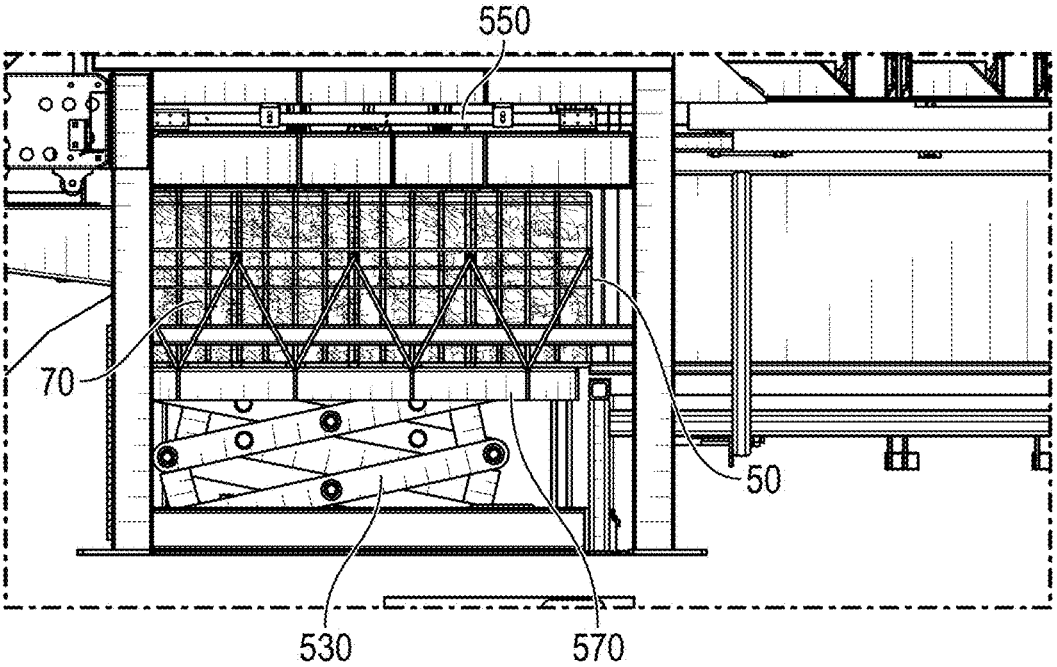
FIG. 15 is a side view of a portion of the log assembly of FIG. 14.
Figure 16:
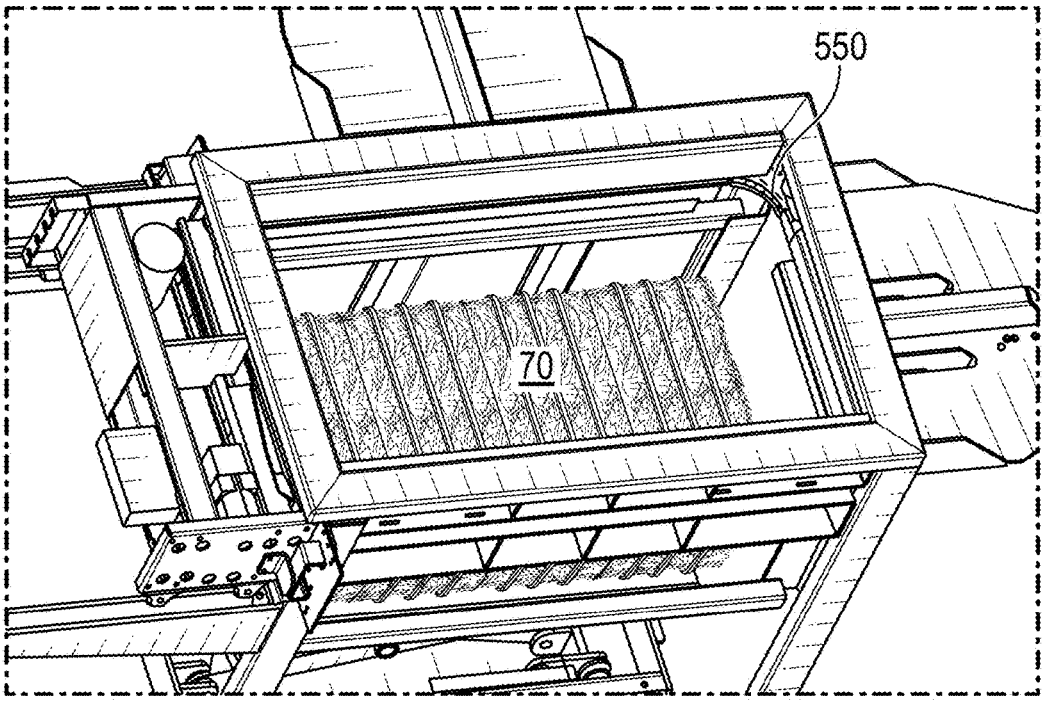
FIG. 16 is an isometric view from above the portion of the log assembly shown in FIG. 15.

FIG. 15 shows a front view of the banding station 500 that appears at the left of FIG. 14. As shown, all four bales 50 are now pressed into a log 70 positioned on the banding platform 570, but the log is not yet banded. Just above the log is a banding device 550 that will install a band 76 around the log 70 (making it a banded log 74). (See FIG. 21, Step 65). Below the banding platform 570 is a scissor lift 530 that will be used to raise the log up and hold it in a position to be banded. FIG. 16 shows this from more of a top view, looking down through the banding device 550 at a log 70 sitting on banding platform 570 supported by the compressed scissor lift 530.

As previously explained, while the illustrated embodiment shows four bales per log, the elements discussed herein (such as the banding platform 570 could be adjusted to work with logs consisting of 3 or 5 bales, for example. However the system is configured, once the allocated number of ½ cut bales arrive at the staging area and positioned next to one another into a log, a banding tool 550 places a plastic binding strap around the sides of the log, pulls it tight to a desired tension, and then heat welds the ends together, thereby securing the ½ cut bales into a newly formed banded log. This is done when the scissor lift 530 extends the banding platform 570 up such that the log 70 is approximately halfway above the banding device 550.

Figure 17A:
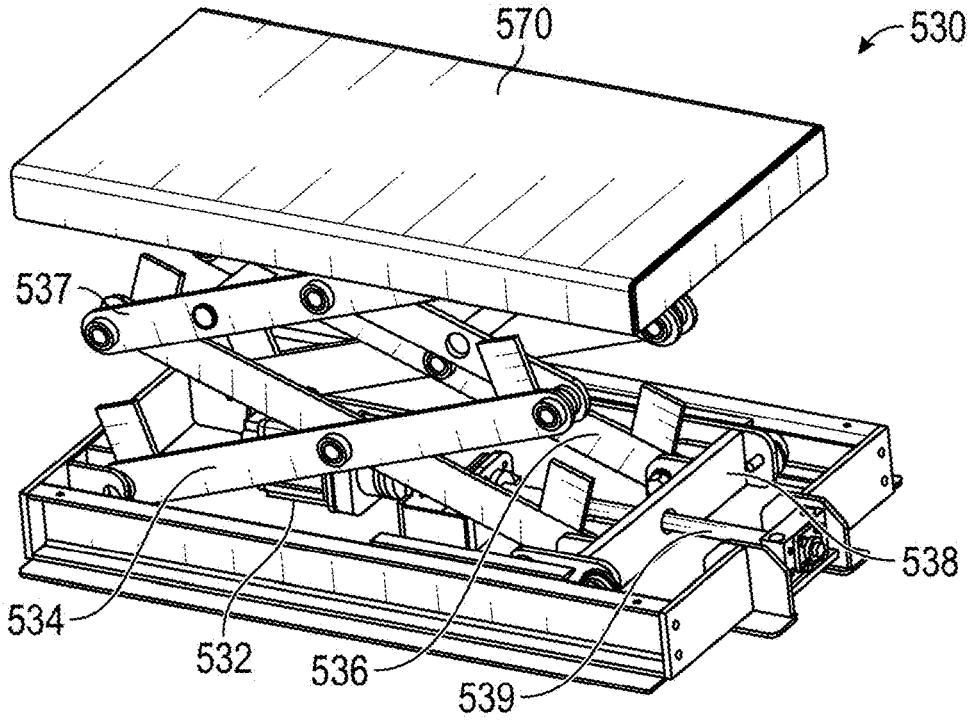
FIG. 17A is an isolated view of a scissor lift in a lowered position in accordance with certain embodiments.
Figure 17B:
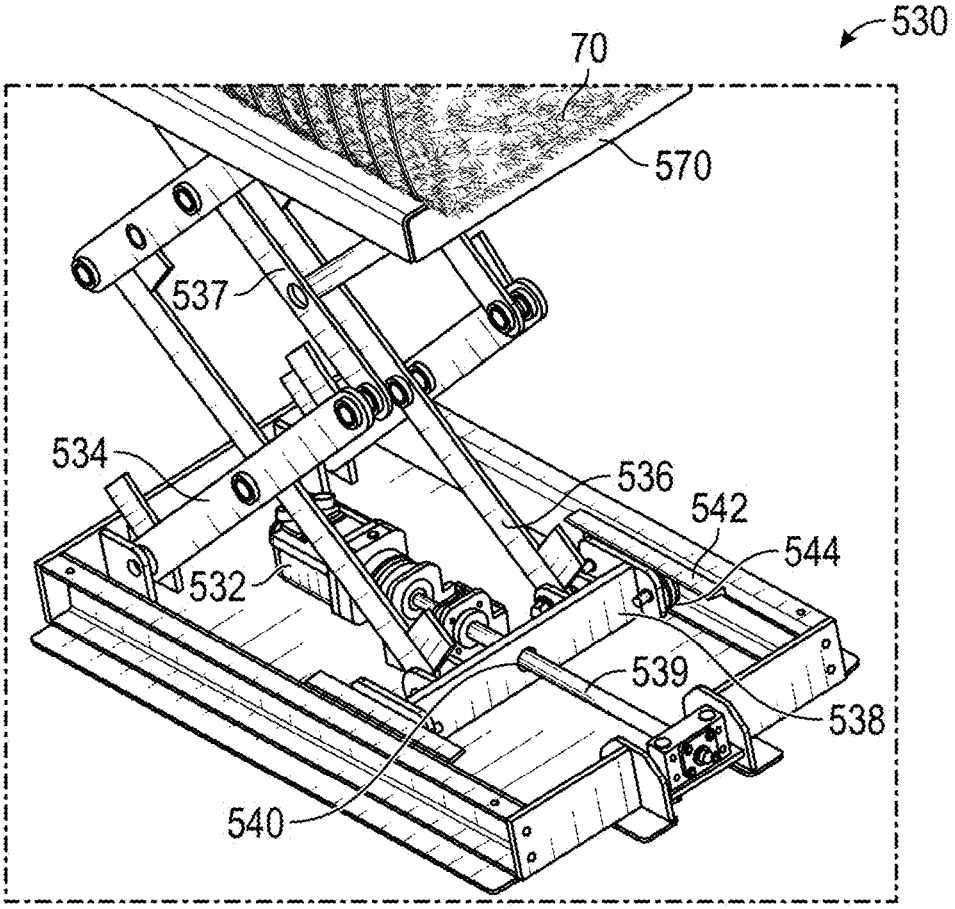
FIG. 17B is an isolated view of a scissor lift in a raised position in accordance with certain embodiments.

FIGS. 17A and 17B show different orientations of the scissor lift 530. At top (17A), the scissor lift is lowered at a position where it would receive new bales to form into a log. At bottom (17B), the scissor lift 530 is raised to present the log to the banding device 550. In the illustrated embodiment, the scissor lift is comprised of a pair of fixed end legs 534 and a pair of moving end legs 536. The fixed end legs have a static end connected to a rotating axle (not shown) fixed to the base of the lift 530. These static ends rotate about the axle, but do not translate or raise. At the center of each fixed end leg, it is pinned to a moving end leg, and at the far end each fixed end leg is pinned to one of a first set of upper legs 537. The moving end legs 536 have a far end pinned to one of a set of second set of upper legs 537, while the opposite (lower) end of the moving end legs is pinned to plate 538. Plate 538 travels along a set of rollers 544 on tracks 542 along the sides of the base of scissor lift 530. The plate travels when servo motor 532 turns a threaded shaft 539 that passes through a central hole 540 in plate 538. The central hole has grooves that align with the threads on shaft 539 to control the movement.

Thus, as the motor 532 turns, the plate moves in (or out) within the base of scissor lift 530, causing fixed end legs 534 and moving end legs 536 to rotate about the centers where they are pinned together. This drives the far ends of the legs higher and closer together, having the same effect in the first and second set of upper legs 537. The far ends of the sets of upper legs support the banding platform 570, thereby raising (or lowering) the platform and its log 70 cargo. This is a controlled manner to handle a lot of weight and move it upward slowly and precisely to position it for banding and higher for moving the log off the platform. However, one of skill in the art would recognize that there are other means for lifting the banding platform, such as that used with the destacking elevator 220.

Figure 18:
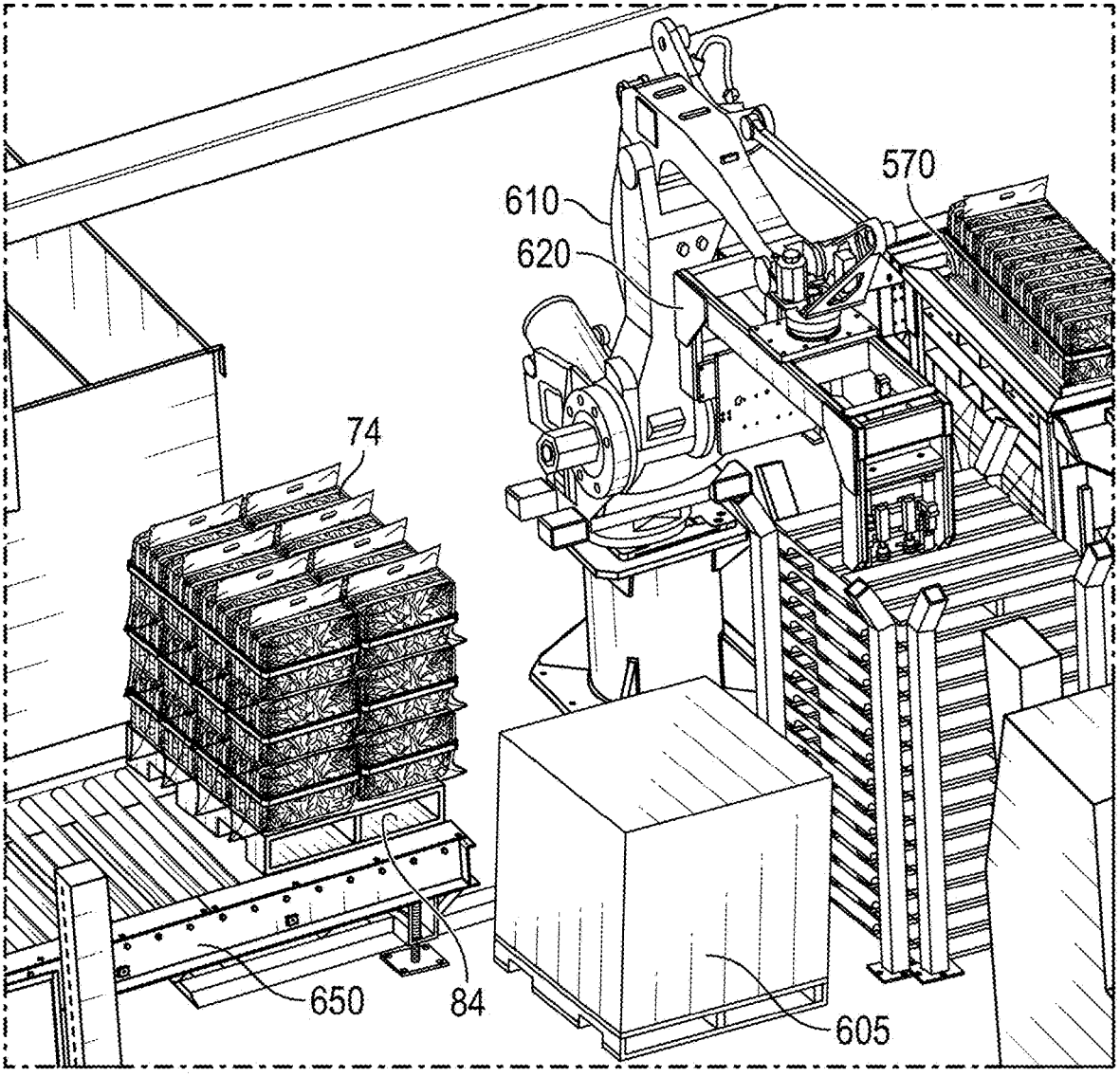
FIG. 18 is a plan view of a first portion of a stacking and wrapping component of the double compressed bale packing assembly of FIG. 3.
Figure 19:
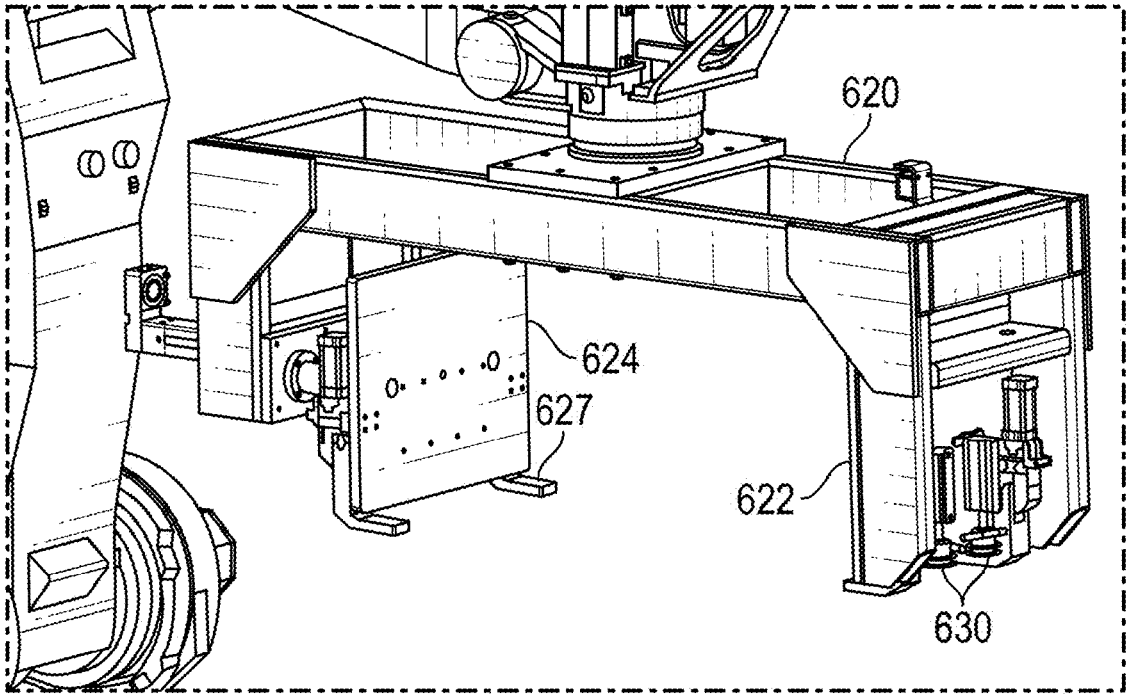
FIG. 19 is an isolated view of a log lift tool.

FIG. 18 moves to the stacking and wrapping 600 portion of the assembly 100. At top right is a banded log 74, still sitting on the now fully-raised banding platform 570. After banding, the scissor lift 530 continues pushing the banded log 74 higher to this position to present it for manipulation by stacking robot 610. Stacking robot 610 may be much the same as bagging robot 270 but for the tool it is fitted with. Stacking robot 610 moves entire logs, so it is equipped with log lift tool 620, which is best shown in FIG. 19. Log lift tool features a fixed plate 622 and a floating plate 624 that moves toward and away from the fixed plate based on presence indicators and/or programming commands. Each of the plates have tongues 627 extending inward from their base that scoop under the bottom of the outer bales of a banded log 74 to facilitate lifting. On the backside of each plate is a plurality of suction cups 630. The suction cups extend down from the plate along actuators or rods to engage with a slip sheet 80 that are positioned between levels of palletized logs.

Returning to FIG. 18, in operation, the stacking robot 610 would first place an empty pallet 84 on the wrapping line 650. It would then, using suction cups 630, retrieve a slip sheet 80 from the cardboard stack 680 and place it on the pallet 84. It then retrieves a first, and when it is ready, a second banded log 74 from the banding platform 570, placing them on the slip sheet 80. If slip sheets are desired in between the levels, it would then grab another slip sheet and repeats the process until the desired stack is created. (See FIG. 21 at Step 70). As shown, the finished palletized stack on wrapping line 650 is complete except for placing a final slip sheet 80 on top. The stack comprises a total of 6 logs, or 24 compressed bales. More or less ½ cut bales on a single pallet is possible, but this configuration has been found to work well for shipping. From here, the rollers of the wrapping line will engage to move the palletized stack slowly toward the wrapping area.

Figure 20:
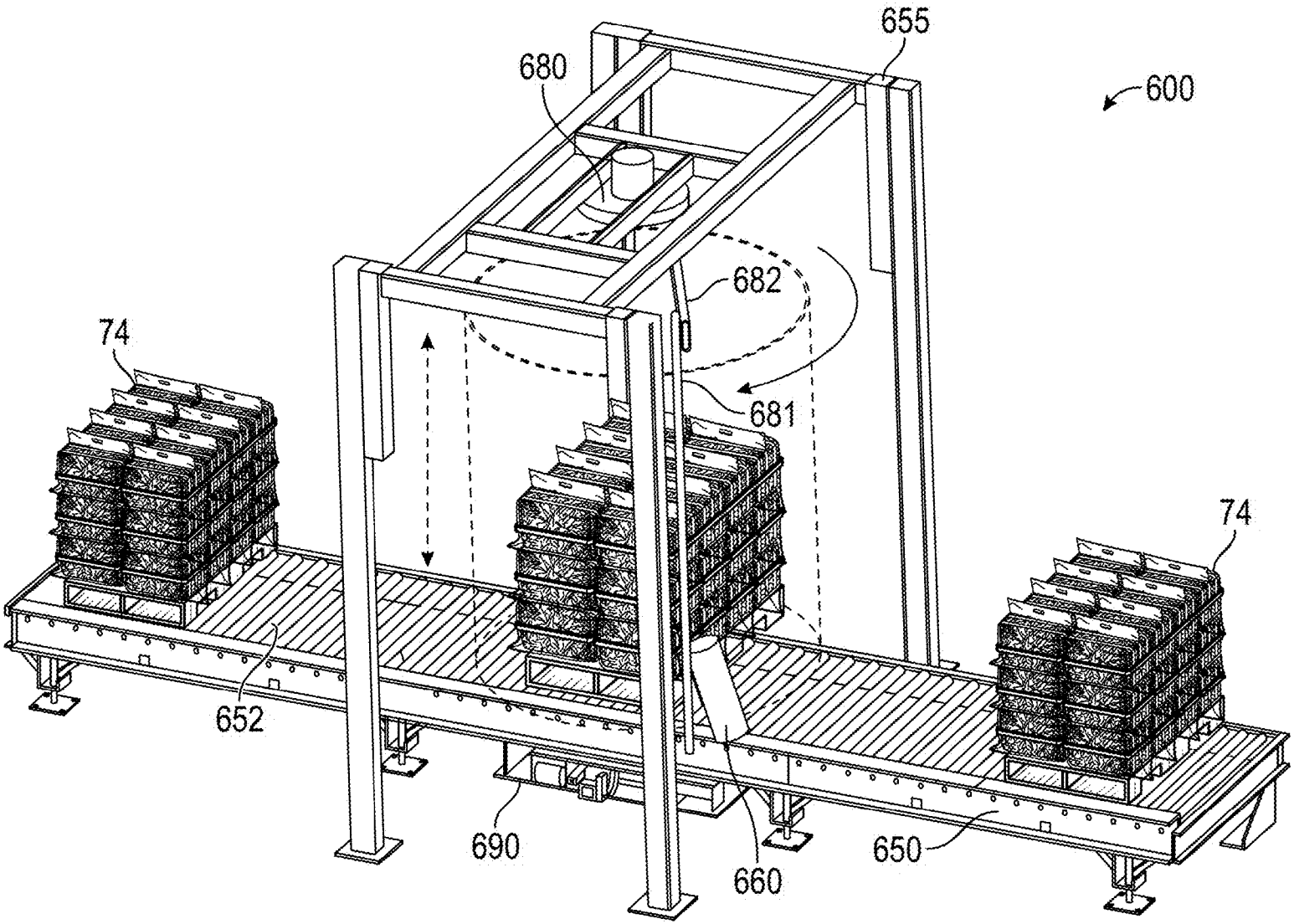
FIG. 20 is a plan view of a second portion of the stacking and wrapping component of FIG. 18.
Figure 20A:
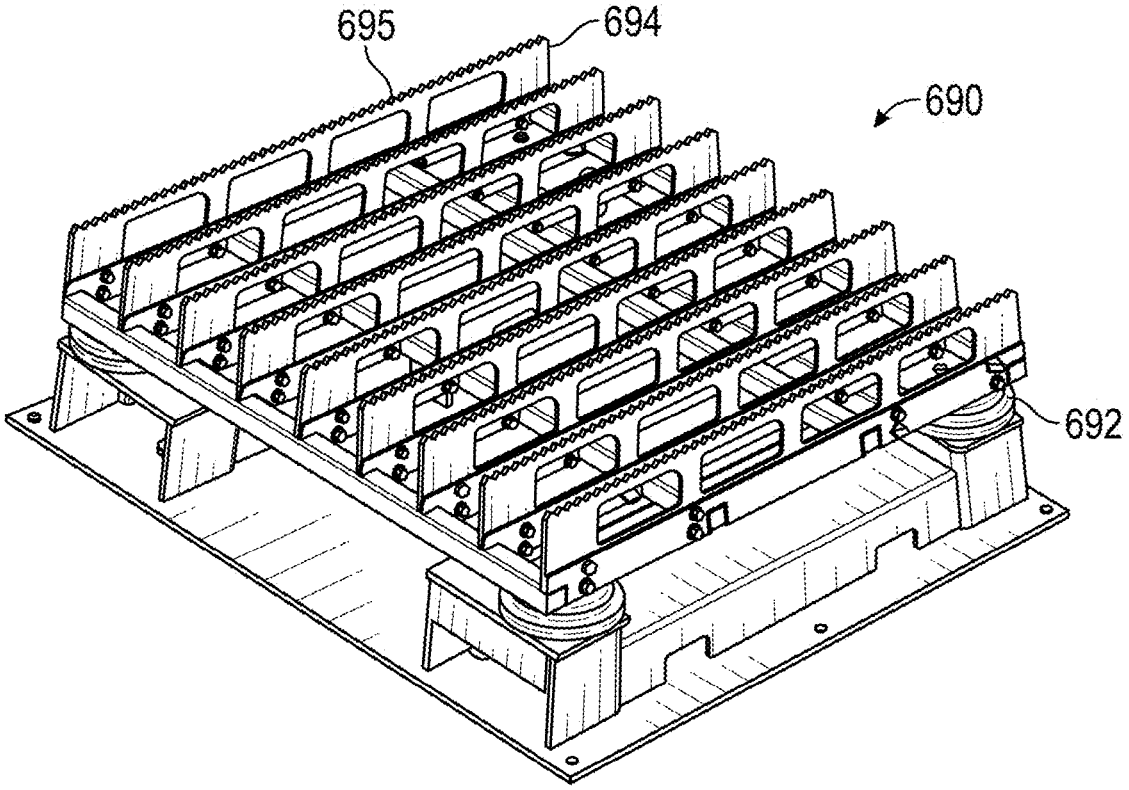
FIG. 20A is an isolated view of a pallet lift component of the stacking and wrapping component of FIG. 18.

Though it is desirable to allow the ½ cut bales to dry out and breathe while in the container bags, the need to keep the logs stable on the pallet during shipping is temporarily more important. This is especially so when combined with the need to protect the ½ cut bales from the elements, which may include salt water during overseas transport. Accordingly, as shown in FIG. 20, the palletized load is moved to a location along the wrapping line positioned within a shrink wrap unit 655. Shrink wrap unit 655 comprises a wrapper boom 681 that extends down from an arm 682 that connects to and rotates with a central wheel 680. It also comprises a pallet lift 690, which is best shown separately in FIG. 20A. The pallet lift is a platform positioned beneath the conveyor line 650 that comprises a series of pneumatic air bags 692 used to raise a series of ribs 694 that fit in between the rollers 652 of the wrapping line 650. The ribs 694 have a series of teeth 695 designed to dig into the bottom of wooden pallet 84 to hold it in place.

Once a palletized load is properly positioned under the wheel 680, the pneumatic air bags 692 fill causing the ribs 694 of the pallet lift 690 to lift the palletized load up off the rollers 652 of the conveyor line 650. The wheel 680 then begins to rotate, spinning the wrapper boom 681 around the perimeter of the palletized load. As it does so, shrink wrapper head 660 travels vertically along the boom to dispense shrink wrap around the perimeter of the palletized load. (FIG. 21, Step 75). The shrink wrap is much thinner than the gauge of the container bags, and is typically no more than $1/1000^{th}$ of an inch (one "mil"). Depending on the height of the load and the length of the shrink wrapper head 660, the head may move up and down along the wrapper boom 681 to fully cover the palletized load with the desired layers of shrink wrap. After a few rotations of the wrapper boom, the palletized stack of banded logs is fully secured together and ready for shipping. A cutting device or heat wand is used to cut off the end of the shrink wrap, and the pneumatic air bags 692 deflate, causing the pallet lift 690 to lower the palletized load back on to the line driven rollers 652. Finally, the rollers 652 convey the now-shrink wrapped pallet of banded logs to the end of the wrapping line 650 where a forklift can fetch the pallet and load it into shipping container or truck for its final destination.

Thus, the above-described system accomplishes the goal of quickly, efficiently and securely packing and protecting individual ½ cut bales for shipment to their destination, where they can remain in their individual container bags for some time until conveniently ready for use by the end user. Bags are serialized with information about when the bales were packed and other information as desired. The entire process is fully automated, only requiring monitoring or maintenance, and initial input and setup selection. FIG. 21, the steps of which are mentioned in relevant portions throughout the disclosure above, shows a high-level overview of most of the process steps of the illustrated embodiment. It will be appreciated that not all steps need to be performed in each instance, and certain unique aspects or qualities about the process may only relate to certain process steps or process steps not shown in FIG. 21 but rather described above and shown in the other figures. Further, it will be apparent that many of the steps of FIG. 21 comprise several individual steps not specifically broken out, but apparent from the above disclosure. For example, Step 58 (bag closing) involves a number of sub steps as disclosed in association with FIGS. 11 and 12.

To operate the various components of the above-described system, the bale packing assembly 100 uses a control system 700, an example of which is shown in FIG. 22. The control system 700 is run by a central controller 710 that comprises one or more processors 715, a memory 720 and a transceiver or similar communication module 725 for interfacing with other components of the system 700. The system 700 also includes and/or utilizes communication network 740 to communicate between the different components of the system.

Processor(s) 715 may be any suitable processing device or set of processing devices such as, but not limited to, a microprocessor, a microcontroller-based platform, an integrated circuit, etc. Memory 720 may include one or more of volatile memory, non-volatile memory, read-only memory, etc. In some examples, memory 720 may include a combination of multiple kinds of memory, such as volatile memory and non-volatile memory. Memory 720 is computer readable media on which one or more sets of instructions, such as the software for operating the steps of the instant disclosure, can be embedded. The instructions may embody one or more of the steps or logic as described herein. For example, the instructions reside completely, or at least partially, within any one or more of memory 720, the computer readable medium, and/or within processor(s) 715 during execution of the instructions.

The terms "non-transitory computer-readable medium" and "computer-readable medium" include a single medium or multiple media, such as a centralized or distributed database, and/or associated caches and servers that store one or more sets of instructions. Further, the terms "non-transitory computer-readable medium" and "computer-readable medium" include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

In the illustrated example, central controller 710 includes communication module 725. In other examples, communication module 725 may be separate from and in communication with central controller 710. Communication module 725 is configured to enable wired or wireless communication. As used herein, the term "module" refers to hardware with circuitry configured to perform one or more functions. A "module" may also include firmware that executes on the circuitry to enable the one or more functions to be performed.

Communication module 725 includes wired or wireless network interfaces to enable communication with network 740 that is connected to other components of the system. Communication module 725 may also include hardware and software to control the wired or wireless network interfaces. For example, communication module 725 may include hardware, software, and network interfaces for communication via wireless local area networks (WLANs), such as Wi-Fi®, or in some cases via cellular network(s) to send and receive messages beyond the local area. Network 740 may be a WLAN and/or may include communication via near-field personal communication means such as Bluetooth®. In some embodiments, network 740 includes wired connections as primary or backup communication means.

Though the entire system described above is automated, not every action need be managed directly by the central controller 710. The majority of automated steps are operated by local logic controls connected to position indicators, broadly labeled in FIG. 22 as 790. Position indicators 790 exist throughout the system 100 to identify when certain actions are to be taken. For example, a position indicator may be set up to scan for the presence (or absence) of a bale 50 at a certain position in the system. Once that condition is met, the position indicator triggers a pre-programmed step to take place, such as, for example, a conveyor to move forward a certain distance, rollers to turn, a plunger to push forward a certain distance, a bag corner holder to extend or retract, paddles to extend and clamp gates to drop, a robot to perform a certain programmed maneuver, etc. These pre-programmed actions are controlled and can be performed without involvement of or instruction from central controller 710.

In other cases, there are steps where a decision is to be made, or data needs to be analyzed or sent in order to take a next step. In these cases, the central controller 710 is involved. The primary decision point in the illustrated system is at Step 35 of FIG. 21—the bale inspection station. Here, data is collected by, for example, camera(s) 254 and inspection scale 250 that is transmitted to communication module 725 via network 740. This information is used by processor 715 to make a decision (using pre-programmed logic and parameters set by an operator) on whether or not to accept a bale. That decision is then communicated via the communication module 725 back through the network 740 to bag loading robot 270, which (based on the decision) runs one of two sets of instructions. The first set results in the bale being moved to the rework stack 260, while the other results in the bale being loaded in a bag at the bagging station 300.

Another place where the central controller 710 may be involved is with serialization. Here, the central controller may provide the information (via network 740) that is to be stamped on a bag by the serializer 350. In other cases, the serializer 350 may be equipped with basic repeater logic and code to determine what is to be stamped on each bag, but this information is then sent to the central controller 710 for storage in memory 720.

The system 100 also may include various sensors 750 that monitor certain aspects of system performance. For example, there may be a heat sensor that monitors the temperature of the heat sealer 750. There may be inventory sensors configured to send alerts when the system is running low on split sheets 80, shrink wrap, or banding for banding device 550. The sensors 750 are able to send alerts or other data to central controller 710 so that processor 715 can take appropriate action to keep the system running (alert an operator, order more material, etc.). In addition, the central controller 710 can query the sensors 750 for a status of that which they are sensing the condition of, such as to provide on demand updates to an operator.

Control system 700 also comprises one or more graphical user interfaces (GUIs) to allow an operator to interface with the system. The term GUI, as used herein, is broadly defined and may include one or more of the interfaces of a standard laptop or desktop computer, a mobile phone, a smart watch, a factory display screen, or an internet website accessible by any such device. GUIs 780 may be used by an operator to change parameters of the system, check on the status of the system, retrieve serialization data or otherwise. Also, such a connection allows the central controller 710 to send alerts to operators identifying issues with the system, the need for more inventory, etc.

As discussed above, central controller 710 need not direct most of the functions of the system because they can be controlled locally by position sensors. However, in some embodiments the central controller 710 can communicate a signal to one or all of the position sensors 790 in the system to halt operations. A position sensor 790 is a simple logic device that basically has two commands, such as Stop and Go. If it senses presence (or absence), it signals Go (such as to a driven roller to perform a function) until it no longer senses the triggering event and then it signals Stop. In response to a shutdown command from the central controller 710, regardless of what the position sensor senses, it only signals Stop until the command is withdrawn by the central controller 710. This override feature allows the central controller 710 to essentially shut down the entire assembly in the event of some malfunction, at the request of an operator, according to a time table, etc. In addition, it allows the central controller 710 to manage the process by slowing it down at any position along the assembly.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. An automated bale packing assembly comprising:

a destacking elevator for separating a first bale from other bales;

a bale bagging station comprising a plurality of holders positioned to hold open a first end of a container bag;

a bale handler tool configured to lift the first bale and insert it into the first end of the container bag;

a closing assembly configured to close the first end of the container bag; and a heat sealer to seal the first end of the container bag;

wherein each of the destacking elevator, the bale bagging station, the bale handler tool, the closing assembly, and the heat sealer cooperate to seal the first bale into the container bag without human intervention.

2. The automated bale packing assembly of claim 1, wherein each of the bale bagging station, the bale handler tool, the closing assembly and the heat sealer are connected to a central controller through a communication network.

3. The automated bale packing assembly of claim 1, wherein the bale handler tool comprises a plunger for depositing the first bale within the container bag.

4. The automated bale packing assembly of claim 1, wherein the holders each have a first position where they do not extend into the first end of the container bag and a second position where they do extend into the first end of the container bag and press outward against an inner surface thereof.

5. The automated bale packing assembly of claim 4, further comprising a pneumatic nozzle positioned to blow air into the first end of the container bag.

6. The automated bale packing assembly of claim 5, wherein the holders are configured to shift from their first positions to their second positions while the pneumatic nozzle is blowing air into the first end of the container bag.

7. The automated bale packing assembly of claim 1, further comprising a serializer for marking the container bag with information about the first bale.

8. The automated bale packing assembly of claim 1, wherein the closing assembly comprises first and second paddles configured to extend into the first end of the container bag and move away from one another, thereby drawing opposing inner surfaces of the first end of the container bag together.

9. The automated bale packing assembly of claim 1, further comprising an inspection scale for measuring the weight of the first bale, wherein the weight is used to determine whether the bale handler tool will insert the first bale into the first end of a container bag or deposit the first bale on a rework stack.

10. The automated bale packing assembly of claim 1, wherein the destacking elevator is configured to receive a log of bales containing the first bale.

11. The automated bale packing assembly of claim 10, wherein the destacking elevator is further configured to vertically align the first bale with an inspection scale.

12. An automated method for preparing bales of hay or the like for shipment comprising the steps of:

retrieving a container bag and positioning it over a bagging platform, the container bag having an unsealed first end opposite a closed second end;

opening the unsealed first end of the container bag and holding the unsealed first end open using a plurality holders;

inserting a bale into the unsealed first end of the container bag using a bale handler tool;

depositing the bale inside the container bag to create a filled container bag;

sliding the filled container bag down a chute onto a sealing conveyor such that the closed second end is facing down and the unsealed first end is facing up;

closing the unsealed first end of the filled container bag; and sealing the unsealed first end of the filled container bag with a heat sealer, thereby forming a sealed first end;

wherein each of the foregoing steps are performed automatically without human intervention.

13. The automated method of claim 12, wherein each of the foregoing steps are performed in response to receiving data from one of: a position indicator or a central controller.

14. The automated method of claim 12, wherein the step of opening the unsealed first end of the bag further comprises blowing air into the unsealed first end using a pneumatic nozzle.

15. The automated method of claim 12, wherein the closed second end comprises a top flap and a handle used to carry the container bag.

16. The automated method of claim 12, wherein the container bag is comprised of material that is translucent and breathable.

17. The automated method of claim 12, wherein the step of closing the first end of the filled container bag further comprises releasing clamp gates down to press opposing sides of the unsealed first end together thereby forming a bottom edge.

18. The automated method of claim 17, wherein the step of sealing the unsealed first end of the filled container bag with a heat sealer further comprises operating the seal conveyor to move the bottom edge from between the clamp gates into a feeding channel of the heat sealer.

19. The automated method of claim 12, further comprising a step of banding the filled container bag together with at least two other filled container bags to form a log.

20. The automated method of claim 19, further comprising a step of palletizing and wrapping a plurality of logs together into a group for shipping, wherein all of the foregoing steps are performed without human intervention.

* * * * *